US012185805B1

(12) United States Patent
Flannery et al.

(10) Patent No.: US 12,185,805 B1
(45) Date of Patent: Jan. 7, 2025

(54) CANE APPARATUS

(71) Applicant: Regalo International, LLC, Burnsville, MN (US)

(72) Inventors: Mark A. Flannery, Longboat Key, FL (US); Kasey L. Pipo, Elko New Market, MN (US); William D. Butterfield, River Falls, WI (US)

(73) Assignee: Regalo International, LLC, Burnsville, MN (US)

( * ) Notice: Subject to any disclaimer, the term of this patent is extended or adjusted under 35 U.S.C. 154(b) by 175 days.

(21) Appl. No.: 18/096,384

(22) Filed: Jan. 12, 2023

Related U.S. Application Data

(60) Provisional application No. 63/299,880, filed on Jan. 14, 2022.

(51) Int. Cl.
*A45B 9/04* (2006.01)
*A45B 9/02* (2006.01)
*A45B 9/00* (2006.01)

(52) U.S. Cl.
CPC ..... *A45B 9/04* (2013.01); *A45B 9/02* (2013.01); *A45B 2009/007* (2013.01)

(58) Field of Classification Search
CPC ..... A45B 9/04; A61H 2003/001
See application file for complete search history.

(56) References Cited

U.S. PATENT DOCUMENTS

| | | | | | |
|---|---|---|---|---|---|
| 2,642,074 | A * | 6/1953 | Pedley | A61H 3/02 | 135/65 |
| 2,782,796 | A | 10/1954 | Blue | | |
| 3,170,475 | A * | 2/1965 | Forbes | A45B 3/00 | D3/17 |
| 3,273,575 | A * | 9/1966 | Aldrich | A61H 3/0288 | 135/84 |
| 4,258,735 | A * | 3/1981 | Meade | A45B 3/00 | 135/65 |
| 4,274,430 | A | 6/1981 | Schaaf et al. | | |
| 4,493,334 | A | 1/1985 | Semanchik et al. | | |
| 5,318,057 | A | 6/1994 | Wallum | | |
| 5,385,163 | A * | 1/1995 | Fairchild | A45B 3/00 | 135/65 |
| 8,919,362 | B1 * | 12/2014 | Mortenson | A45B 3/00 | 482/76 |
| 9,468,271 | B2 * | 10/2016 | Troy, Jr. | A45B 9/04 | |
| 10,188,183 | B1 | 1/2019 | Swerdlow | | |
| 2004/0144410 | A1 | 7/2004 | Cheng et al. | | |

* cited by examiner

*Primary Examiner* — Noah Chandler Hawk

(57) ABSTRACT

The present apparatus includes a cane portion that engages a base portion that in turn engages a platform portion. The platform portion is pivotable between up and down positions. The apparatus is used for walking when the platform portion is in the up position. The apparatus may be used to assist a user in walking up and down stairs and curbs when the platform portion is in the down position. The base portion may engage the lower end of the cane by a resilient socket or by a threaded fastener that pinches the lower end of the cane.

23 Claims, 14 Drawing Sheets

CANE APPARATUS

This application claims the benefit under 35 U.S.C. 119 (e) of U.S. Provisional Patent Application No. 63/299,880 filed Jan. 14, 2022, which is hereby incorporated by reference in its entirety into this application.

FIELD OF THE INVENTION

The present invention relates to a cane and more particularly relates to a cane having a step assist platform that helps a user navigate steps and curbs.

BACKGROUND OF THE INVENTION

A cane is great help to the injured or elderly. A cane acts like a third leg. Or it can be said that the cane acts like an extension to an arm. In either case, the third point of contact with a ground surface enables a nonambulatory person to ambulate and to be independent when otherwise he or she would be in a wheelchair or dependent upon another person.

SUMMARY OF THE INVENTION

A feature of the present invention is the provision in a cane apparatus, of a unique third point of contact with a ground surface.

Another feature of the present invention is the provision in a cane apparatus, of a multidimensional third point of contact with a ground surface.

Another feature of the present invention is the provision in a cane apparatus, of a cane portion, where the cane portion includes a proximal end section with a handle, and where the cane portion further includes a distal end section.

Another feature of the present invention is the provision in a cane apparatus, of a base portion, where the base portion receives and engages the distal end section of the cane, and where the base portion includes a base face. Another feature of the present invention is the provision in a cane apparatus, of a platform portion, where the platform portion is pivotally engaged to the base portion, where the platform portion includes first, second, and third faces, where the platform portion is pivotable to an up position where the first face of the platform portion and base face of the base portion define a plane, where the platform portion is pivotable to a down position where the second face of the platform portion and base face of the base portion define a plane, where the third face of the platform portion is opposite of the second face of the platform portion and is stepped upon by the user when the platform portion is in the down position, and where the first face of the platform portion is disposed transversely to each of the second and third faces of the platform portion.

Another feature of the present invention is the provision in a cane apparatus, of the base face of the base portion and the first face of the platform portion making contact with a ground surface when the platform portion is in the up position and when the cane apparatus is used for walking.

Another feature of the present invention is the provision in a cane apparatus, of the base face of the base portion and the second face of the platform portion making contact with the ground surface when the platform portion is in the down position and when the platform portion is used to assist the user when the user is climbing or descending a change in height of the ground surface.

Another feature of the present invention is the provision in a cane apparatus, of the platform portion including a channel extending inwardly into the platform portion from the third face and having an axis, where the cane portion includes a straight section having an axis, and where the channel receives the straight section of the cane portion when the platform portion is in the up position such that the axis of the channel of the platform portion and axis of the straight section of the cane portion are parallel.

Another feature of the present invention is the provision in a cane apparatus, of the platform portion including a fourth face, where the fourth face is opposite of the first face, and where the channel further extends inwardly into the platform portion from the fourth face to permit the cane portion to extend out of the fourth face of the platform portion when the platform portion is in the up position.

Another feature of the present invention is the provision in a cane apparatus, of the channel further extending inwardly into the platform portion from the first face to permit the base face of the base to pivot into a plane with the first face when the platform portion is pivoting into the up position.

Another feature of the present invention is the provision in a cane apparatus, of the channel further extending inwardly into the platform portion from the second face to permit the base face of the base portion to pivot into a plane with the second face when the platform portion is pivoting into the down position.

Another feature of the present invention is the provision in a cane apparatus, of the cane portion including an offset section and a straight section, where the straight section of the cane portion includes a straight axis, where the offset portion of the cane portion extends away from the straight section of the cane portion and away from the handle, where the straight axis intersects the handle, the distal end section of the cane portion, and the base face of the base portion, where the straight section extends into the offset section, where the offset section extends into the handle, and where the offset section is offset from the straight axis of the straight section.

Another feature of the present invention is the provision in a cane apparatus, of the platform portion including first and second channel sections, where the cane portion includes a straight section with a straight axis, where in the up position of the platform portion the first channel section is co-axial with the straight axis of the straight section of the cane portion, where in the down position of the platform portion the first channel section is perpendicular to the straight axis of the straight section of the cane portion, where in the up position of the platform portion the handle extends transversely relative to each of the first and second channel sections, and where in the down position of the platform portion the handle extends transversely to each of the first and second channel sections of the platform portion.

Another feature of the present invention is the provision in a cane apparatus, of the distal end section of the cane portion being engagable and disengagable from the base portion such that the cane portion may be removed from the base portion and be used as a support for walking without the base portion.

Another feature of the present invention is the provision in a cane apparatus, of the base portion including a resilient sidewall that resiliently engages the distal end section of the cane portion when the distal end section of the cane portion is pushed into the base portion.

Another feature of the present invention is the provision in a cane apparatus, of the base portion including a cap portion and a socket portion that are threadably engagable to and threadably disengagable from each other, where the socket portion receives the distal end section of the cane portion, and where the cap portion when threadably engaging the socket portion decreases a diameter of the socket portion such that the socket portion tightens about the distal end section of the cane portion to engage the distal end section of the cane portion with the base portion.

Another feature of the present invention is the provision in a cane apparatus, of the cane portion including an opening and the platform portion including a tab, the tab of the platform portion engaging the opening of the cane portion when the platform portion is in the up position to removably hold the platform portion in the up position.

Another feature of the present invention is the provision in a cane apparatus, of the tab of the platform portion and opening of the cane portion being a friction fit engagement.

Another feature of the present invention is the provision in a cane apparatus, of the platform portion including a channel in which the cane portion is received when the platform portion is in the up position, where the platform portion includes a surface that forms at least a portion of the channel, and where the tab extends from the surface.

Another feature of the present invention is the provision in a cane apparatus, of the cane portion including a straight section between the handle and the distal end section, where the straight section is extendible in length between at least first and second positions, and where the cane portion is lockable at the first and second positions.

Another feature of the present invention is the provision in a cane apparatus, of the cane portion including a straight section between the handle and the distal end section, where the straight section includes a first telescoping part and a second telescoping part, where the first and second telescoping parts are lockable at a first position and at a second position such that the cane portion is extendible and retractable in length.

Another feature of the present invention is the provision in a cane apparatus, of the platform portion including first and second platform sections interconnected by an intermediate platform section, where the first platform section includes a portion of each of the first, second, and third faces, where the second platform section includes a portion of each of the first, second, and third faces, where the intermediate platform section includes a portion of the second face, where the intermediate platform section is spaced from the third face, and where the intermediate platform section is spaced from the first face.

Another feature of the present invention is the provision in a cane apparatus, of the platform portion including first and second platform sections interconnected by an intermediate platform section, where each of the first and second platform sections includes a first part engaged during assembly to a second part, where the first part includes a portion of the first face and a portion of the third face, and where the second part includes a portion of the first face and a portion of the second face.

Another feature of the present invention is the provision in a cane apparatus, of a first pivot connection between the first platform section and the base portion and a second pivot connection between the second platform section and the base portion, where the first and second parts of the first platform section engage the first pivot connection, and where the first and second parts of the second platform section engage the second pivot connection.

Another feature of the present invention is the provision in a cane apparatus, of a fourth face opposite to the first face, where the first platform section includes a first platform interior integral support extending between the first and fourth faces of said first platform section and being spaced from the second and third faces of said first platform section, and where the second platform section includes a second platform interior integral support extending between the first and fourth faces of said second platform section and being spaced from the second and third faces of the second platform section.

Another feature of the present invention is the provision in a cane apparatus, of the platform portion including first and second platform sections interconnected by an intermediate platform section, where the intermediate platform section is adjacent to the base portion when the platform portion is in the up position, and where the intermediate platform section is spaced from the base portion when the platform portion is in the down position.

Another feature of the present invention is the provision in a cane apparatus, of the platform portion including a fourth face, where the fourth face is opposite of the first face, and where the platform portion includes first and second platform sections interconnected by an intermediate platform section, where the first platform section includes a first portion of the fourth face that tapers downwardly and away from the cane portion when the platform portion is in the up position, and where the second platform section includes a second portion of the fourth face that tapers downwardly and away from the cane portion when the platform portion is in the up position.

Another feature of the present invention is the provision in a cane apparatus, of the platform portion including first and second platform sections, where each of the first and second platform sections includes an interior network structure.

Another feature of the present invention is the provision in a cane apparatus, of, in the up position of the platform portion, the platform portion extending to a first distance from a first side of the cane portion and to a second distance from a second side of the cane portion, where the first and second distances are substantially equal to each other.

An advantage of the present invention is that a point of contact with a ground surface can be easily changed from a walking point of contact to a point of contact that assists the user in navigating a change in elevation of the ground surface. In the up position of the platform portion, the present invention may be employed as a cane. Then by simply pivoting the platform portion to the down position, the present invention may be used as a step assist where the platform portion is placed next to a rather high curb or a rather high rise of a step of a staircase such that the user can essentially change the curb or rise from a one step effort to a more manageable two step effort.

Another advantage of the present invention is that the cane apparatus may be used just like a conventional cane when the platform portion is in the up position and where the conventional cane has a spread base.

Another advantage of the present invention is that that cane portion may be removed from the cane apparatus and used just like a conventional cane where the conventional cane has a simple one point end.

Another advantage is that the cane portion may be easily removed from the cane apparatus as a whole.

Another advantage is that the cane portion is securely removably engaged to the cane apparatus as a whole.

Another advantage is that the cane apparatus is stable when the platform portion is in the down position.

Another advantage is that the cane apparatus as a whole is relatively lightweight. One feature contributing to this advantage is that the cane portion is tubular or hollow. Another feature contributing to this advantage is that platform portion formed of plastic. Another feature contributing to this advantage is that each of the platform sections is essentially hollow with minimal internal support, where the minimal internal support for each of the platform sections includes a) an intermediate floor support spaced from the second and third faces and extending from the first face to the second face, and b) a lattice or honeycomb structure or network of horizontal and vertical supports.

Another advantage of the cane apparatus is that, when the handle is extending on a line in the direction of travel, the platform portion extends at a right angle to such line of travel.

Another advantage of the cane apparatus is that, if the user wishes the platform portion to extend at another angle, the cane portion is easily disengaged, turned, and easily re-engaged with the base portion extending at any angle about a 360 degree circle.

Another advantage is that the length of the cane portion is easily adjusted.

Another advantage is that in the up position the platform portion extends equally to each of the sides of the case portion such that the user may switch hands and not be troubled by the platform portion extending excessively inwardly toward his or her feet.

Another advantage is that the cane apparatus is simple to use in the up position when walking.

Another advantage is that the cane apparatus is simple to use in the down position when navigating a change in elevation.

Another advantage is that the cane apparatus is simple and inexpensive to manufacture.

DESCRIPTION

Figure 1A:
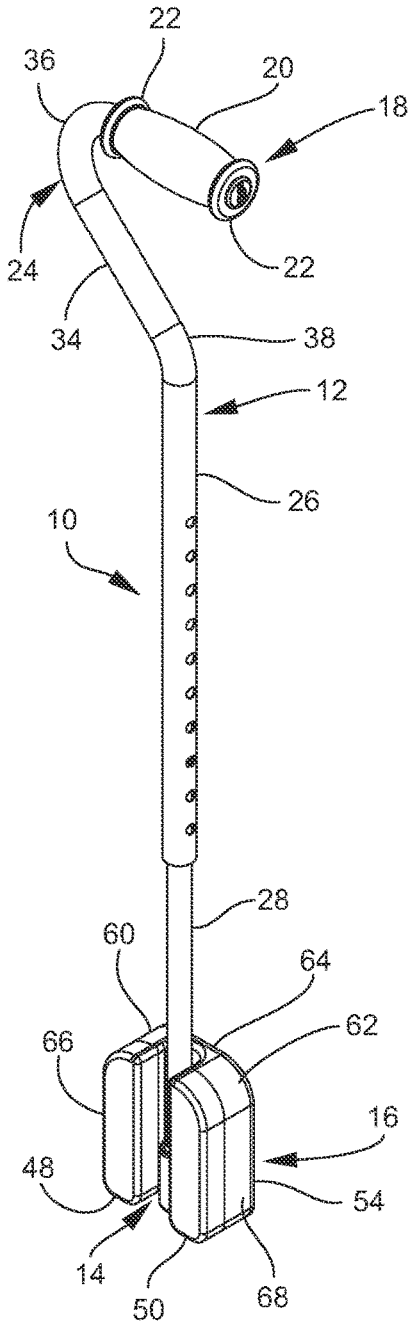
FIG. 1A is a perspective view of a first embodiment of the present cane apparatus, where the cane apparatus includes a cane and a pivoting step or platform portion, and shows the pivoting step in an up position.
Figure 1B:
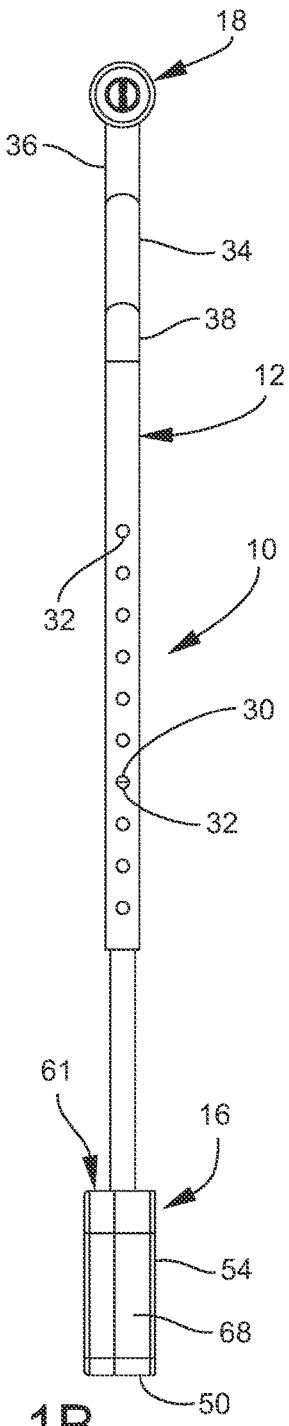
FIG. 1B is a rear view of the cane apparatus of FIG. 1A, and shows the pivoting step in the up position.
Figure 1C:
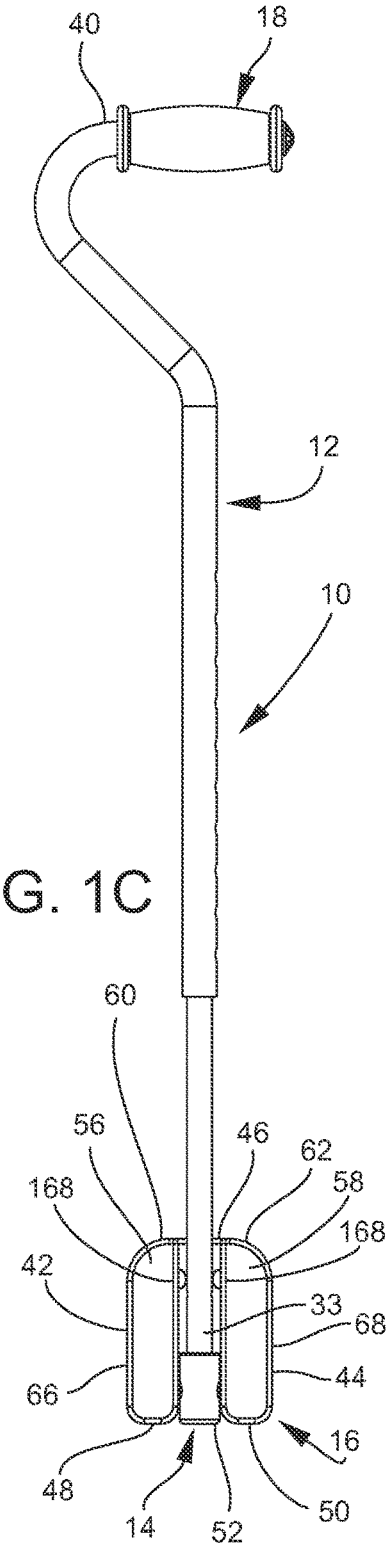
FIG. 1C is a side view of the cane apparatus of FIG. 1A, and shows the pivoting step in the up position.

As shown in FIGS. 1A, 1B, and 1C, a first embodiment of the present cane apparatus is indicated by reference number 10. Cane apparatus 10 includes a cane portion 12, a base portion 14, and a pivoting step or platform portion 16. Base portion 14 is pivotally engaged to platform portion 16. Platform portion 16 is shown in the up position in FIGS. 1A, 1B, and 1C.

Cane portion 12 includes a handle 18. Handle 18 includes a grip portion 20 bounded on each end by a hand stop 22. Handle 18 extends into an offset portion 24. Offset portion 24 extends into a first straight telescoping tubular part 26 engaging a second straight telescoping part 28. Telescoping part 28 is a lower part and is received in the upper telescoping part 26. Telescoping part 28 houses a spring biased button 30 that extends through the cylindrical sidewall of telescoping part 28 to further extend through one of ten openings 32 formed in the cylindrical sidewall of telescoping part 62 to lock the telescoping parts 26, 28 relative to each other and to therefore fix the cane portion 12 at a certain length or height. Telescoping part 28 includes a lower end section or distal end section 33 that is engaged in base portion 14. Handle 18 may be referred as an upper end section or proximal end section of the cane portion 12.

Telescoping parts 26, 28 may be referred to as a straight section of the cane portion 12, which straight section includes an axis that extends through handle 18 and base portion 14. Offset portion 24 is offset from such axis of the telescoping parts 26, 28.

The offset portion 24 includes a straight tubular section 34, a rounded tubular section 36 between straight tubular section 34 and the handle 18, and a rounded tubular section 38 between the straight tubular section 34 and the upper end of the telescoping part 26.

An integral tubular straight handle section 40 extends integrally from rounded section 36. Grip 20 and hand stops 22 are engaged to the straight handle section 40. Tubular straight handle section 40, offset portion 24, and telescoping part 26 are one piece and integral with each other.

Platform portion 16 includes a first platform section 42, a second platform section 44, and an intermediate platform section 46.

First platform section 42 includes one first face portion 48. Second platform section 44 includes another first face portion 50. In combination, first face portions 48, 50 make up a first face 49 to the platform portion 16. First face portions 48, 50 define a plane. A base face 52 of base portion 14 is disposed in and also defines this plane. First face portions 48, 50 make contact with a ground surface when the platform portion 16 is in the up position.

Figure 6:
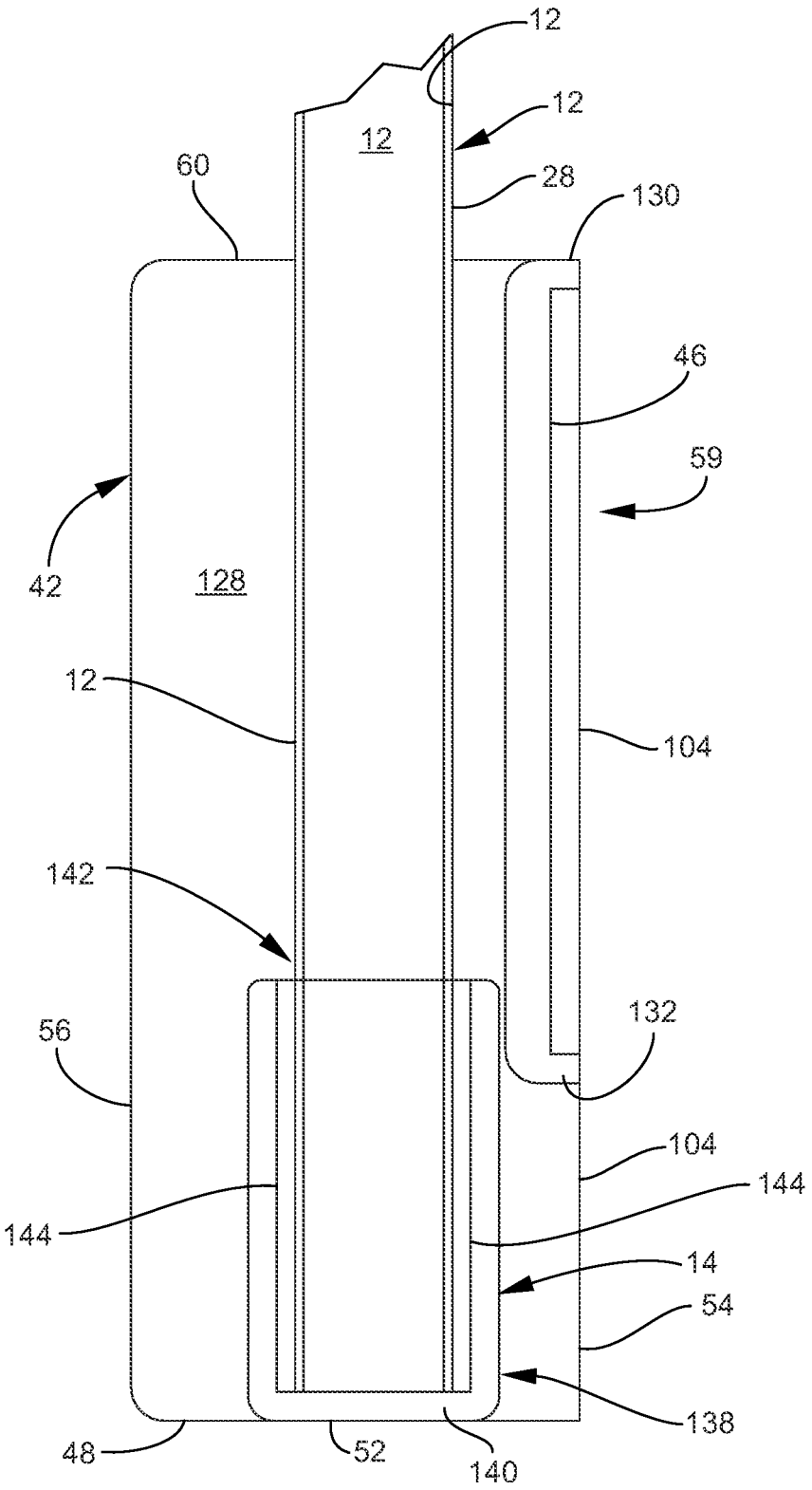
FIG. 6 is a rear diagrammatic view of the cane apparatus of FIG. 1B showing the pivoting step in the up position.

Platform portion 16 includes a second face 54. Second face 54 makes contact with the ground surface when the platform portion 16 is in the down position. Second face 54 defines a plane that is at a right angle to the plane defined by first and second face portions 48, 50. Second face 54 is defined by a portion of first platform section 42, by a portion of second platform section 44, and by a portion of intermediate platform section 46. Second face 54 includes second face portion 55, second face portion 57, and second face portion 59. Second face portion 55 is on the first platform section 42. Second face portion 57 is on the second platform section 44. Second face portion 59 is on the intermediate platform section 46 as shown in FIG. 6.

Platform portion 16 includes a third face 53. This third face is defined by one third face portion 56 and another third face portion 58. Third face portions 56, 58 define a plane. First platform portion 42 includes third face portion 56. Second platform portion 44 includes third face portion 58. The plane of this third face is parallel to and opposite of second face 54. The plane of this third face is disposed at a right angle to the first face and to the plane defined by first face portions 48, 50.

Platform portion 16 includes a fourth face 61. This fourth face includes one fourth face portion 60 disposed opposite of first face portion 48, another fourth face portion 62 disposed opposite of first face portion 50, and another fourth face portion 64 disposed on an end of the intermediate platform section 46.

Platform portion 16 includes a fifth face 66. Fifth face 66 extends between first face portion 48 and fourth face portion 60. Fifth face 66 further extends between third face portion 56 and second face 54. Fifth face 66 is disposed at a right angle to first face portion 48, to second face 54, and to third face portion 56.

Platform portion 16 includes a sixth face 68. Sixth face 68 extends between first face portion 50 and fourth face portion 62. Sixth face 68 further extends between third face portion 58 and second face 54. Sixth face 68 is disposed at a right angle to first face portion 50, to second face 54, and to third face portion 58.

Figure 4A:
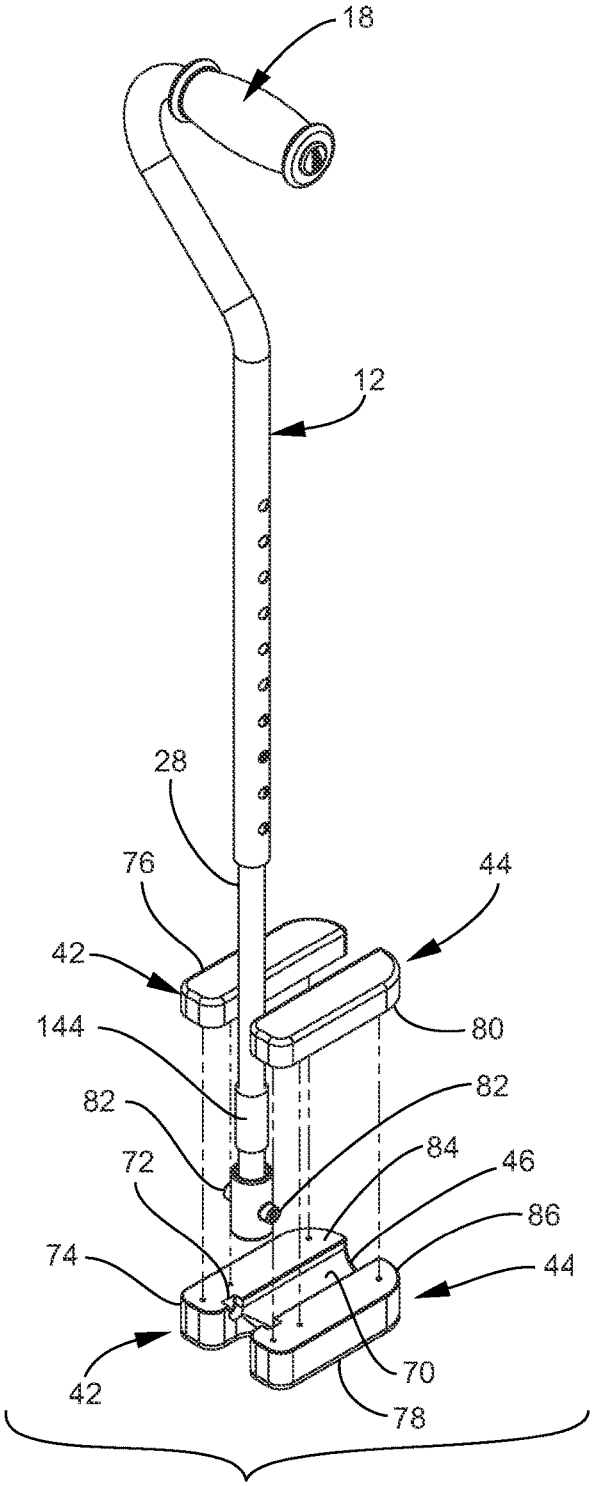
FIG. 4A is a perspective exploded view of the cane apparatus of FIG. 1A.

FIG. 4A shows the intermediate platform section 46 having a cylindrical face 70 opposite to the plane defined by second face 54. Cylindrical face 70 receives or cradles base portion 14 when the platform portion 16 is in the up position.

FIG. 4A shows that the intermediate platform 46 extends short of the plane defined by first face portions 48, 50 and further extends short of pivot connections 72 set in platform portion 16.

FIG. 4A shows that first platform section 42 includes sub-parts 74, 76 and that second platform section 44 includes sub-parts 78, 80. Sub-parts 74, 76 when engaged together, such as with pins, capture one of the pivot pins 82 of base portion 14. Sub-parts 78, 80 when engaged together, such as with pins, capture the other of the pivot pins 82 of base portion 14.

FIG. 4A shows that sub-part 74 includes a ceiling 84 and that sub-part 78 includes a ceiling 86 such that ceilings 84, 86 are intermediate planar supports 84, 86, respectively, for the first and second platform sections 42, 44.

Figure 12:
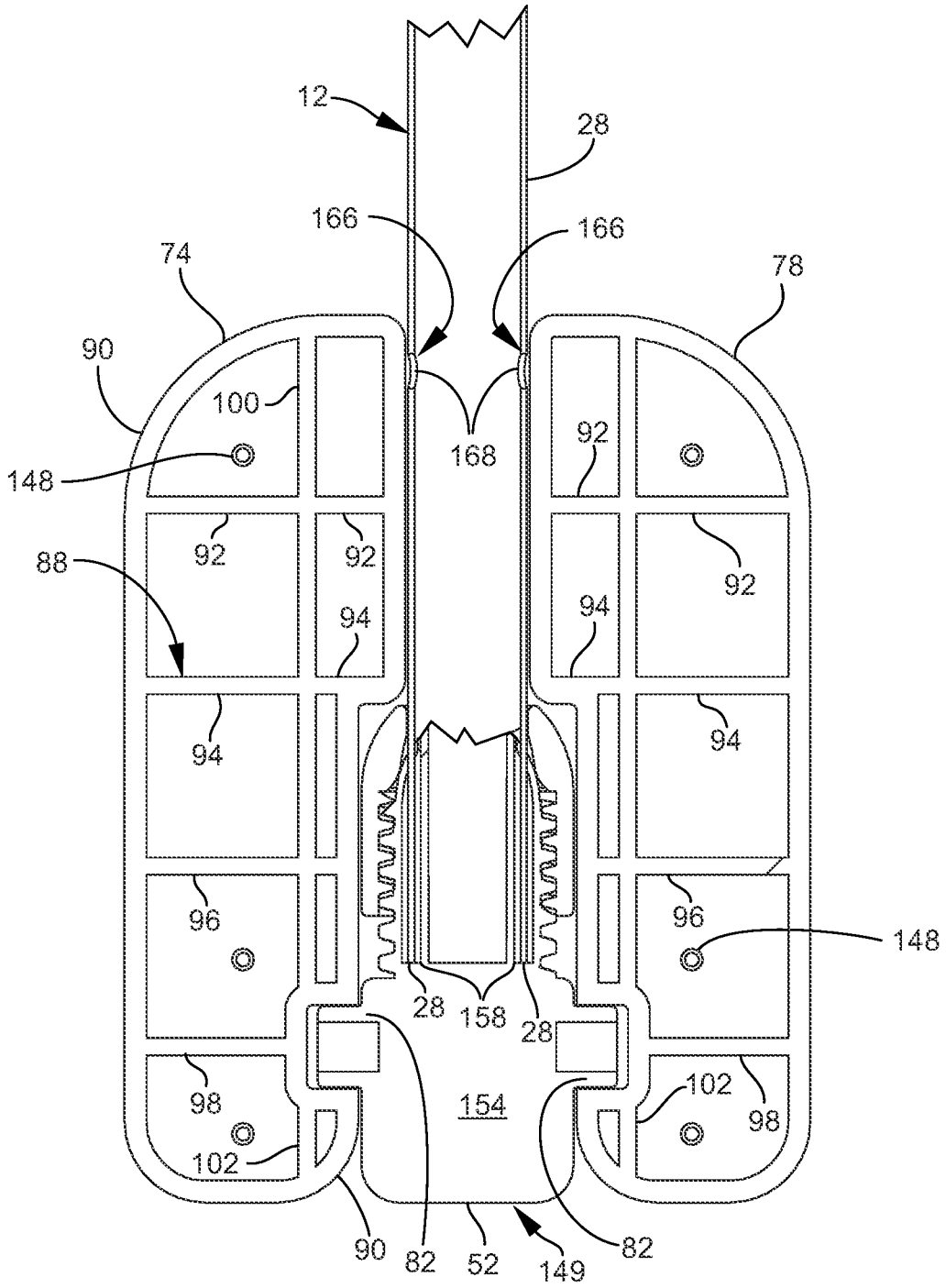
FIG. 12 is a side diagrammatic view of the cane apparatus of FIG. 7C showing the pivoting step in the up position.
Figure 13A:
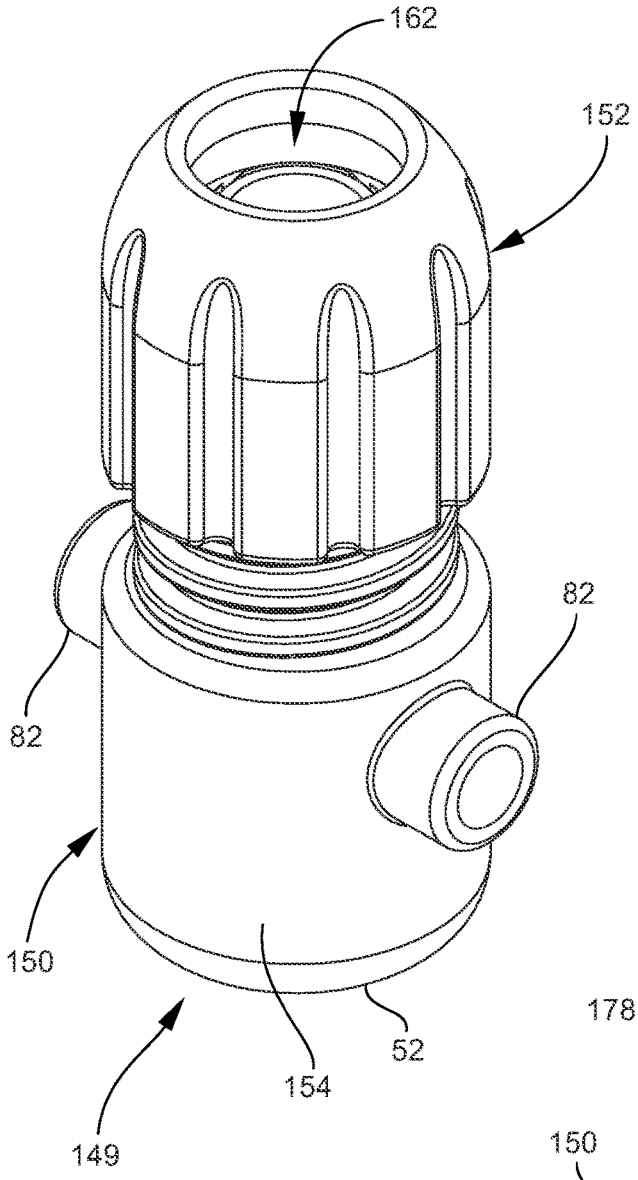
FIG. 13A is a perspective view pivot assembly that engages a bottom portion of the cane of the cane apparatus of FIG. 7A to the pivoting step of the cane apparatus of FIG. 7A
Figure 13B:
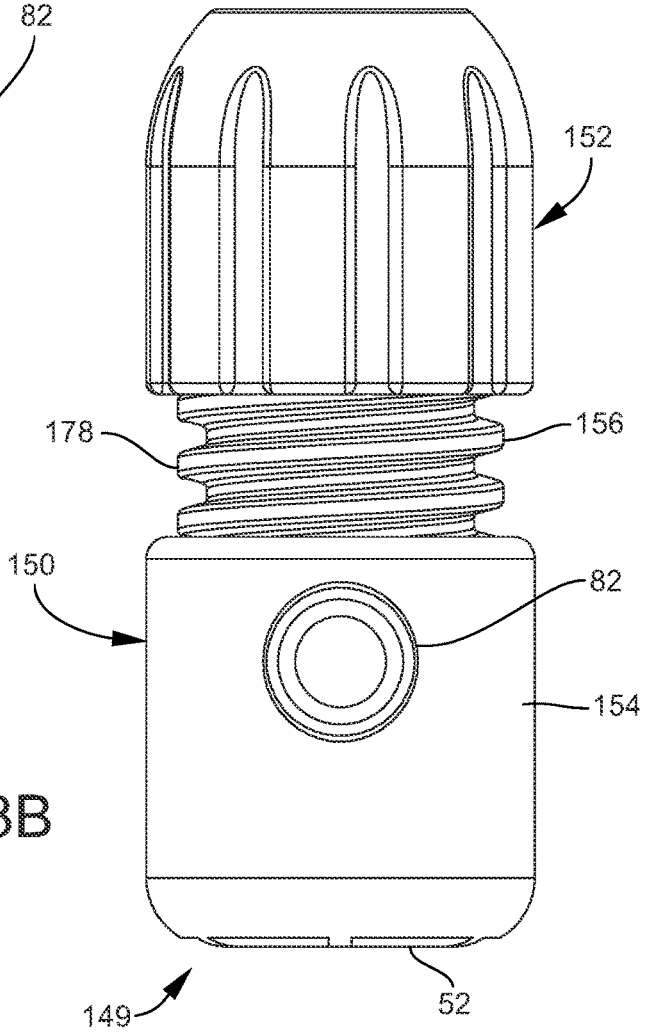
FIG. 13B is a rear elevation view of the pivot assembly of FIG. 13A.
Figure 14A:
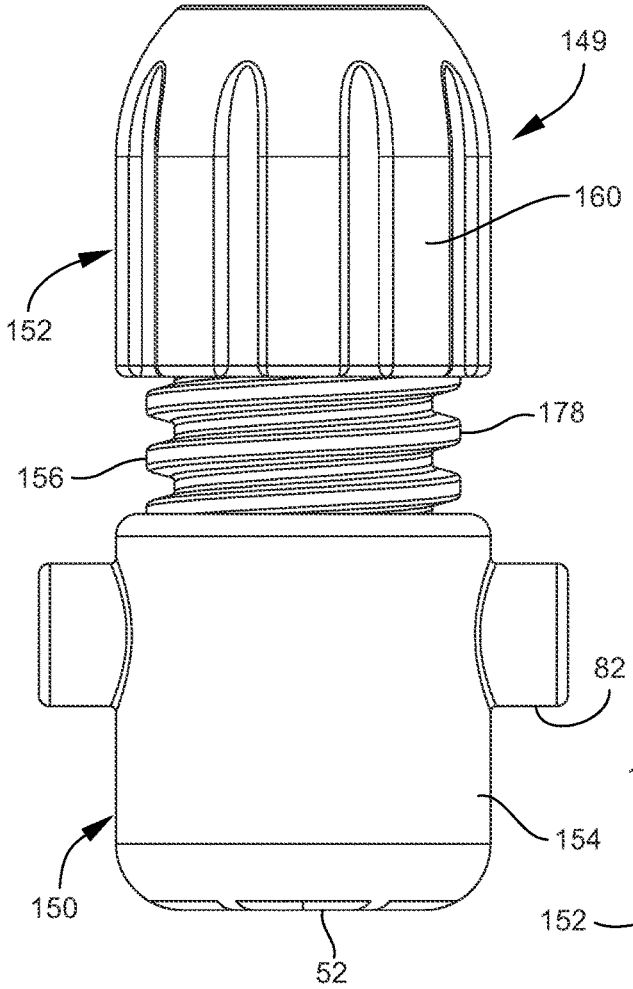
FIG. 14A is a side elevation view of the pivot assembly of FIG. 13A.
Figure 14B:
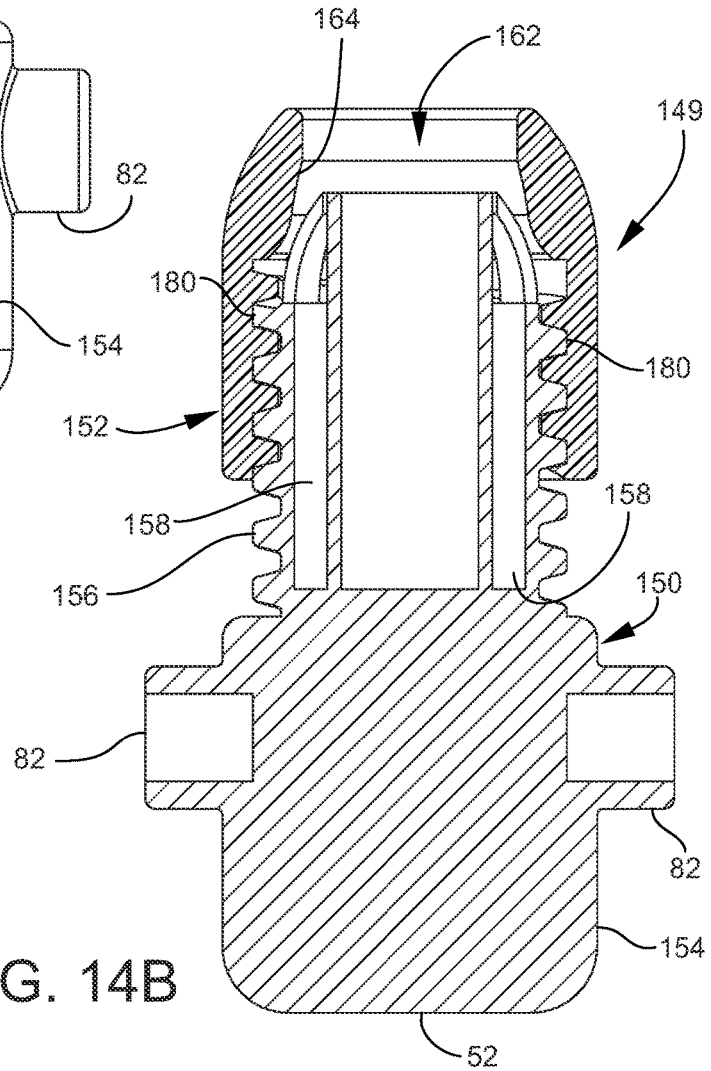
FIG. 14B is a section view of the pivot assembly of FIG. 14A.

FIG. 12 shows a diagrammatic section view of each of sub-parts 74, 78. Each of sub-parts 74, 78 includes an integral network 88 of integral support members. Network 88 is identical but opposite as to each of the sub-parts 74, 78 but will be described as to sub-part 74. A first support member is a peripheral wall 90 running entirely about sub-part 74 and defines portions of the first, fifth, and fourth faces. Internal lateral walls 92, 94, 96, 98 traverse sub-part 74. Each of internal lateral walls 92, 94, 96, 98 integrally extends from an outer portion of the peripheral wall 90 to an inner portion of the peripheral wall 90. Internal longitudinal wall 100 integrally extends from one portion of the peripheral wall 90 to another portion of the peripheral wall 90. Longitudinal wall 102 integrally extends from one portion of the peripheral wall 90 to another portion of the peripheral wall 90. Lateral walls 92, 94, 96 integrally intersect longitudinal wall 100. Peripheral wall 90, lateral walls 92, 94, 96, 98, and longitudinal walls 100, 102 integrally extend from a bottom portion of sub-part 74 to the ceiling 84 of sub-part 74.

Sub-part 78 includes the same network 88 as sub-part 74 but the network 88 of sub-part 78 is a mirror of the network 88 of sub-part 74.

Figure 5:
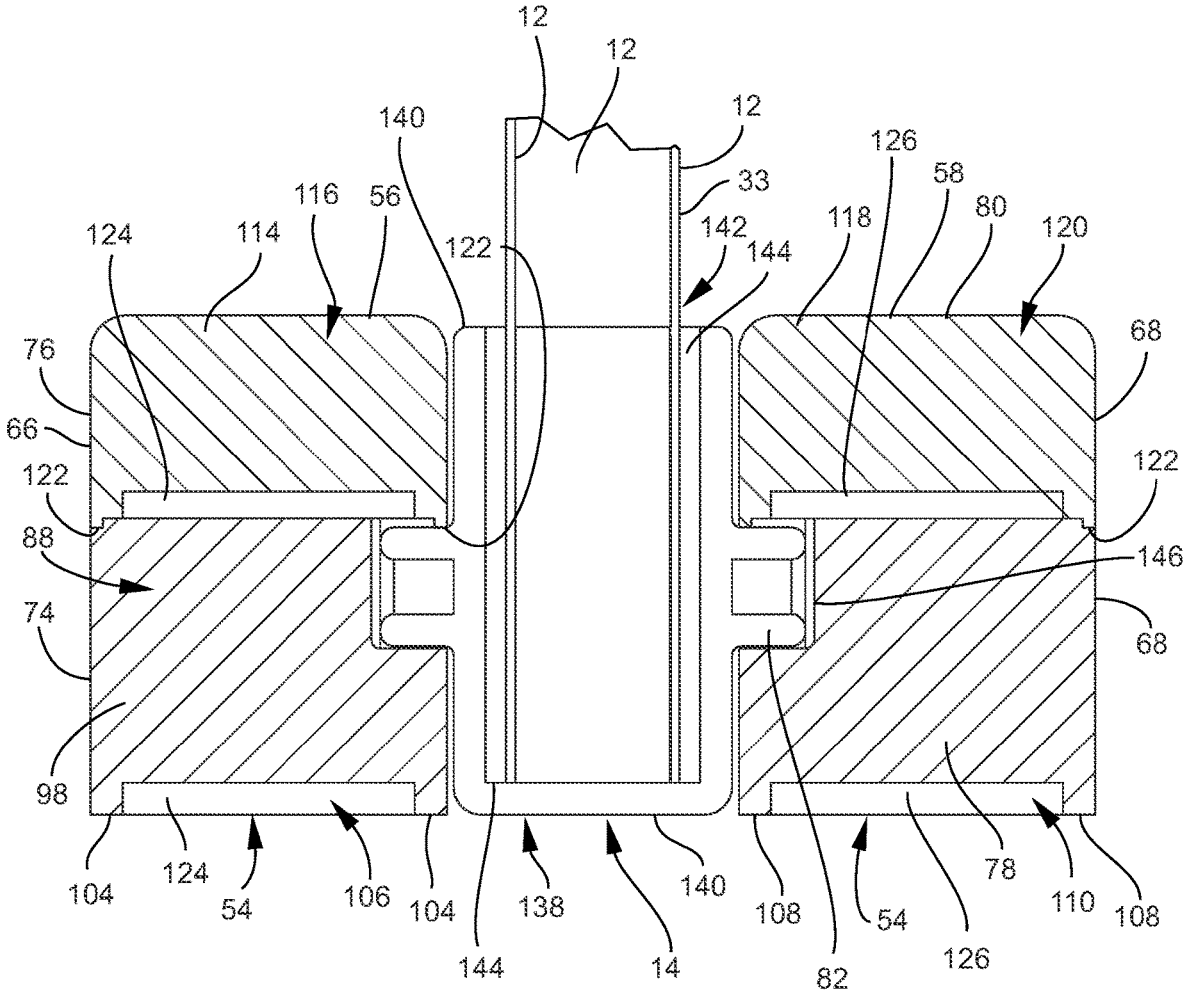
FIG. 5 is a side diagrammatic view of the cane apparatus of FIG. 2C showing the pivoting step in the down position.

FIG. 5 is a diagrammatic section view of platform portion 16. FIG. 5 shows lateral wall 98 of sub-part 74 and lateral wall 98 of sub-part 78.

FIG. 5 shows that face 54 of sub-part 74 is bounded by a peripheral 360 degree foot 104 such that a portion of face 54 of sub-part 74 is defined by a recess 106. Foot 104 also makes up a portion of the first, fifth, and fourth faces of sub-part 74.

FIG. 5 shows that face 54 of sub-part 78 is bounded by a peripheral 360 degree foot 108 such that a portion of face 54 of sub-part 78 is defined by a recess 110. Foot 108 also makes up a portion of the first, sixth, and fourth faces of sub-part 78.

When platform portion 16 is in the down position and makes contact with the ground surface, feet 106 and 108 make contact with the ground surface.

FIG. 5 shows that sub-part 76 includes an integral lateral wall 114 that is part of a network 116. Included in this network 116 are portions of the first, third, fifth, and fourth faces. Fifth face 66 defines a portion of a longitudinal wall of this network 116. First face portion 48 defines a portion of a lateral wall of this network 116.

FIG. 5 shows that sub-part 80 includes an integral lateral wall 118 that is part of a network 120. Included in this network are portions of the first, third, sixth, and fourth faces. Sixth face 68 defines a portion of a longitudinal wall of this network 120. First face portion 50 defines a portion of a lateral wall of this network 120.

FIG. 5 shows a peripheral lip 122 that runs for 360 degrees about the bottom of each of the sub-parts 76, 80. Peripheral lip 122 engages a recess that runs entirely about an upper portion of each of the sub-parts 74, 78 except where an opening is formed in the sub-parts 74, 78 for the pivot pins 82.

FIG. 5 shows rear portion 124 of the fourth face portion 60 and rear portion 126 of fourth face portion 62.

FIG. 6 is a diagrammatical section view showing an inside seventh face 128 of the first platform section 42. Intermediate platform section 46 extends from this inside seventh face 128. Pivot pin 82 extends into this inside seventh face 128. Seventh face 128 defines a plane that is opposite to and parallel to the plane defined by fifth face 66. Fifth face 128 extends between first face portion 48 and fourth pace portion 60. Fifth face 128 extends between third face portion 56 and the portion of the second face 54 on first platform section 42.

FIG. 6 shows that intermediate section 46 includes transverse end lip 130 that leads into peripheral lips 104, 108 of the first and second platform sections 42, 44. FIG. 6 further shows that intermediate section 46 includes a transverse end lip 132 that leads into peripheral lips 104, 108 of the first and second platform sections 42, 44. Peripheral lips 104, 108 and end lips 130, 132 make contact with a ground surface.

Figure 11:
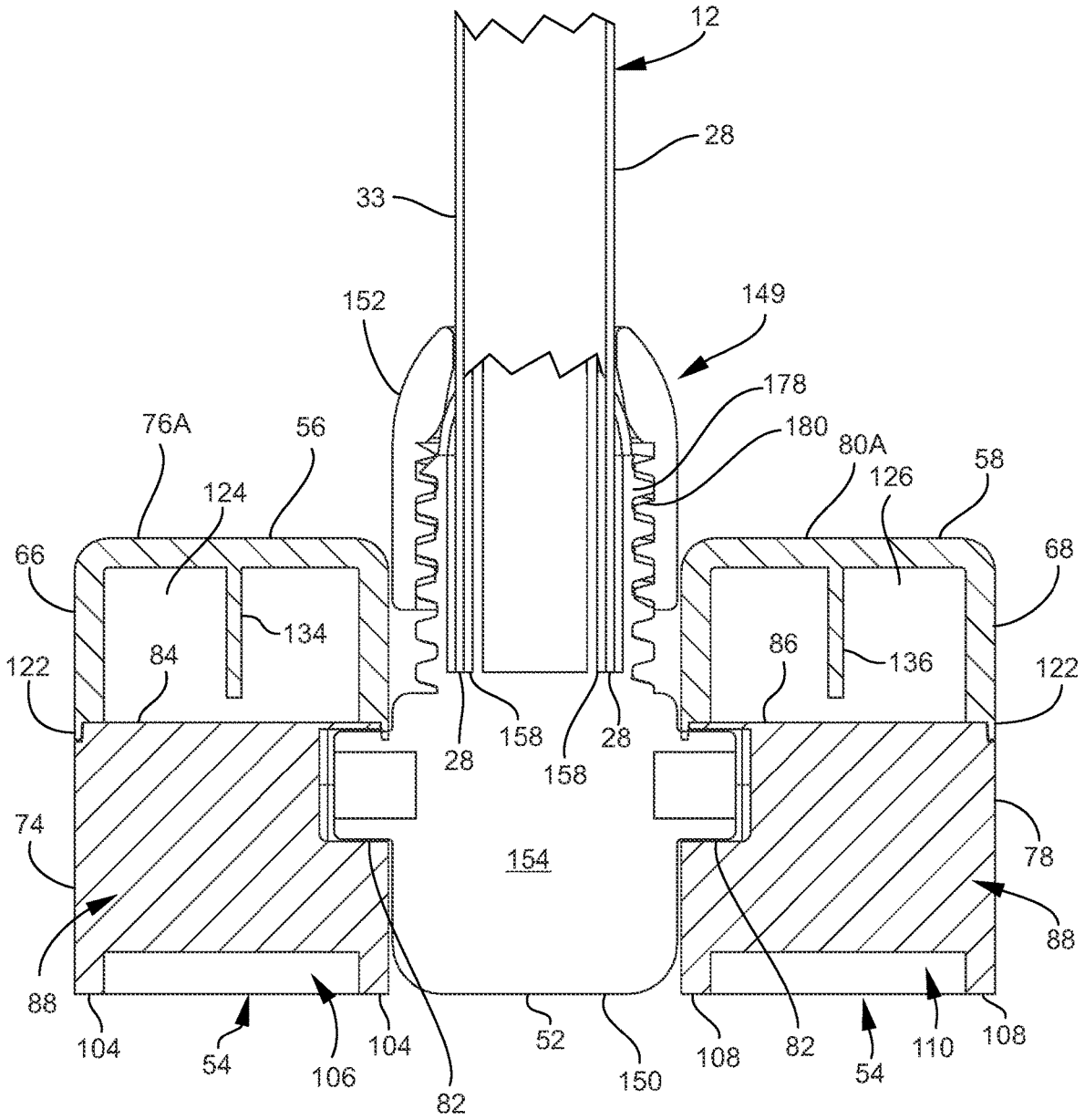
FIG. 11 is a side diagrammatic view of the cane apparatus of FIG. 8C showing the pivoting step in the down position.

FIG. 11 shows an alternate embodiment for sub-parts 76, 80, where alternative sub-parts 76A and 80A have respective intermediate integral vertical ribs 134, 136 integrally depending from respective third face portions 56, 58. Vertical rib 134 integrally extends from fourth face portion 60 to first face portion 48 of first platform section 42. Vertical rib 136 integrally extends from fourth face portion 62 to first face portion 50 of second platform section 44. Each of the vertical ribs 134, 136 is spaced from and adjacent to the ceiling or intermediate support 84, 86 of the respective first and second platform sections 42, 44. When the first and second platform sections 42, 44 are stepped upon, the third face portions 56, 58 resiliently give until the distal ends of the ribs 134, 136 make contact with their respective intermediate supports 84, 86. When inverted, sub-part 76A is receptacle shaped where the four walls of the receptacle are portions of the first, fifth, fourth, and seventh faces and where the bottom of the receptacle is the third face portion 56. When inverted sub-part 80A is also receptacle shaped where the four walls of the receptacle are portions of the first, sixth, fourth, and seventh face and where the bottom of the receptacle is the third face portion 58.

One embodiment of the base portion 14 is shown in FIG. 5. Base portion 14 includes a cylindrical portion 138 having a closed end 140 and an open end 142. Cylindrical portion 138 is a socket. Nestled within the cylindrical portion or socket 138 of base portion 14 is a resilient cylinder 144 of a rubber, rubber-like, elastomeric, or resilient material. The resilient cylinder 144 permits the cane portion 12 to be friction fit or frictionally engaged with the resilient cylinder 144 that in turn is adhesively engaged in the cylindrical portion 138. The friction fit of the cane portion 12 relative to the resilient cylinder 144 and the adhesive fix of the resilient cylinder 144 relative to cylindrical portion 138 of the base portion 14 permit the cane portion 12 to be resiliently engaged and disengaged from the base portion 14 so as to permit the handle 18 to be oriented at any angle over 360 degrees and then, once pushed into the base portion 14, fixed securely at the selected orientation.

FIG. 5 further shows the annular shaped pivot pins 82 that are integral with the cylindrical portion 138. One pivot pin 82 extends into first platform section 42. The other pivot pin 82 extends into second platform section 44. A plate 146, such as a metal plate, is engaged in each of the first and second platform sections 42, 44 so as to abut the outer ends of the pivot pins 82. The plate 146 includes a length about equal to or slightly greater than a diameter of pivot pin 82. In assembly, the pivot pins 82 are engaged in their respective sub-part 74, 78 without sub-parts 76, 80 engaged at such time. Then, after the base portion 14 and pivot pins 82 are engaged in their respective sub-part 74, 78, the respective covering sub-parts 76 80 are engaged to their respective sub-parts 74, 78. Peripheral lip 122 traps and engages pivot pins 82 in the sub-parts 74, 78. Pins are used in pin receivers 148, as shown in FIG. 12, to connect sub-parts 74, 78 to respective sub-parts 76, 80. This pin engagement is also shown by phantom lines in FIG. 4A and FIG. 4B.

A second embodiment 151 of the base portion 14 is shown in FIGS. 7A, 7C, 8A, 8B, 8C, 10A, 10B, 11, 12, 13A, 13B, 14A, and 14B and is designated as base portion 149.

As shown in FIGS. 13A, 13B, 14A, and 14B, base portion 149 includes a socket portion 150 and a cap portion 152. Socket portion 150 and cap portion 152 are threadably engagable and threadably disengagable from each other. Cap portion 152 may be referred to as a thru-cap portion 152.

Socket portion 150 includes co-axial pivot pins 82. Socket portion 150 includes a cylindrical body section 154 and a threaded section 156. Cylindrical body section 154 and threaded section 156 are one-piece and integral with each other and with pivot pins 82. Threaded section 156 includes a cylindrical socket 158 that receives cane portion 12.

Cap 152 includes a roughened exterior surface 160 with ribs to provide for a good manual grip when turning cap portion 152 on and off socket portion 150.

Cap 152 includes a thru opening 162 that permits entry of the cane portion 12 therethrough. Thru-opening 162 includes an inner annular surface 164 that tapers inwardly and outwardly.

When cap 152 is disengaged from socket portion 150, cap 152 may freely slide along cane portion 12. When the distal end of cane portion 12 is in the cylindrical socket 158 and the cap 152 is threaded on and turned on socket portion 150, such a threading decreases the diameter of the cylindrical socket 158 and thereby pinches the distal end of the cane portion 12 in the socket portion 150.

Base portion 149, just like base portion 14, includes base face 52.

Figure 2A:
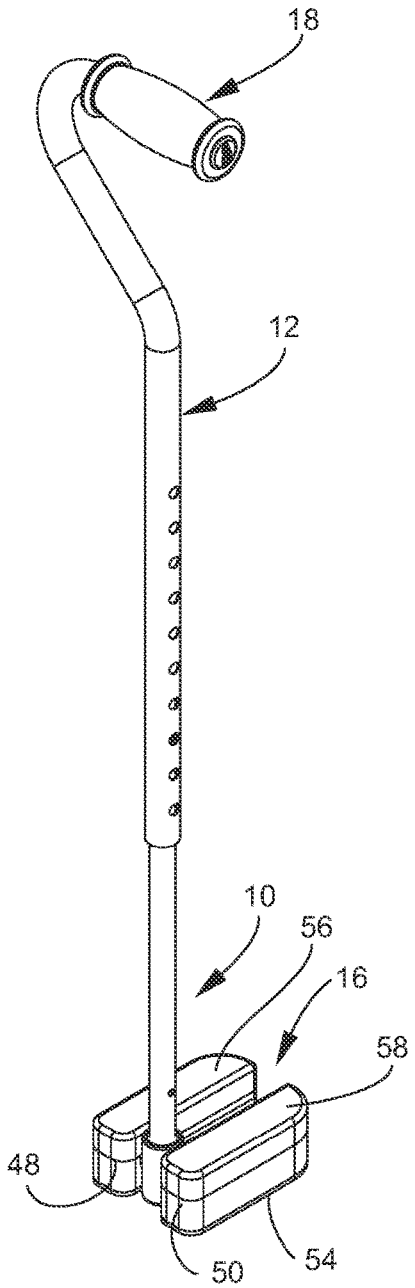
FIG. 2A is a perspective view of the cane apparatus of FIG. 1A, and shows the pivoting step in a down position.
Figure 2B:
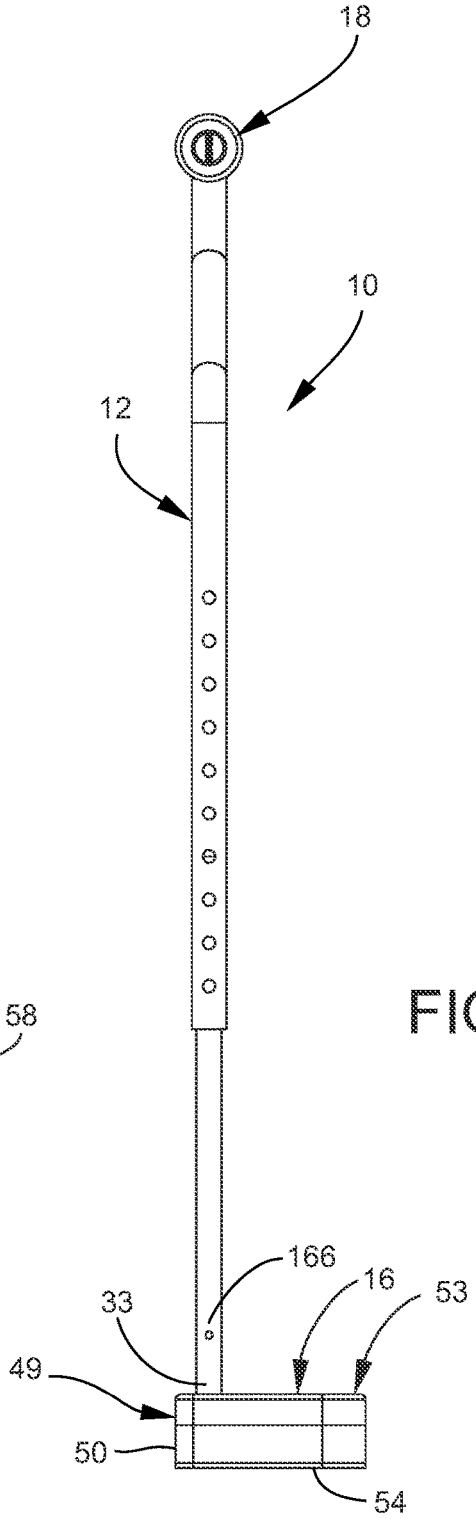
FIG. 2B is a rear view of the cane apparatus of FIG. 2A, and shows the pivoting step in the down position.
Figure 2C:
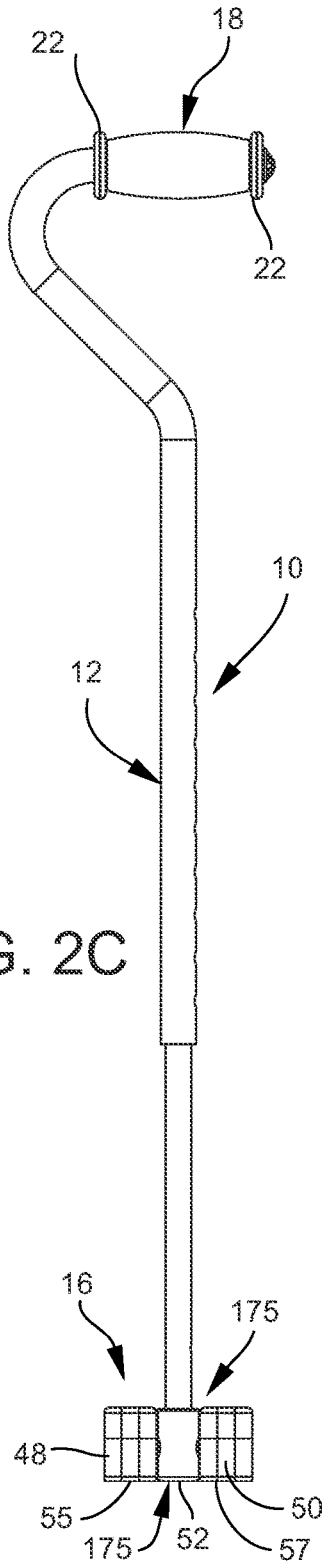
FIG. 2C is a side view of the cane apparatus of FIG. 2A, and shows the pivoting step in the down position.

FIGS. 1A, 1B, and 1C show the platform portion 16 in the up position when, for example, the cane apparatus 10 may be used for walking. FIGS. 2A, 2B, and 2C show the platform portion 16 in the down position when, for example, the cane apparatus 10 may be used to navigate a change in elevation of the ground surface such as a curb or set of stairs.

In FIGS. 1A, 1B, and 1C, first face portions 48, 50 make contact with the ground surface. Here first face portions 48, 50 are disposed at a right angle relative to the straight axis defined by the straight main body of the cane portion 12. In FIGS. 2A, 2B, and 2C, first face portions 48, 50 define a plane that runs parallel to the straight axis defined by the straight main body of the cane portion 12.

In FIG. 1C, base face 52 is co-planar or generally co-planar with the plane defined by first face portions 48, 50. In FIG. 2C, base face 52 is co-planar or generally co-planar with the plane defined by second face 54 and its second face portions 55, 58.

FIG. 2B shows that the telescoping tubular part 28 includes an opening 166. Telescoping tubular part 28 further includes a second opening diametrically opposite of opening 166. Openings 166 cooperate with tabs 168 extending from the seventh surfaces 128 of the first platform section 42 and the second platform section 44. Tabs 168 may be spherical. Tabs 168 work as locks or detents to hold the platform portion 16 in the up position. If desired, tabs 168 may be spring-biased toward the tubular part 28 such that tabs 168 automatically pop into opening 166 when the cane portion 12 and platform portion 16 are rotated into the up position. To disengage the tabs 168 from the openings 166, the cane portion 12 and platform portion 16 are simply rotated from the up position to the down position. Seventh surfaces 128 may be resilient to provide a give and take as the tubular part 28 is engaged and disengaged from the tabs 168 and the first and second platform portions 42, 44.

Figure 3A:
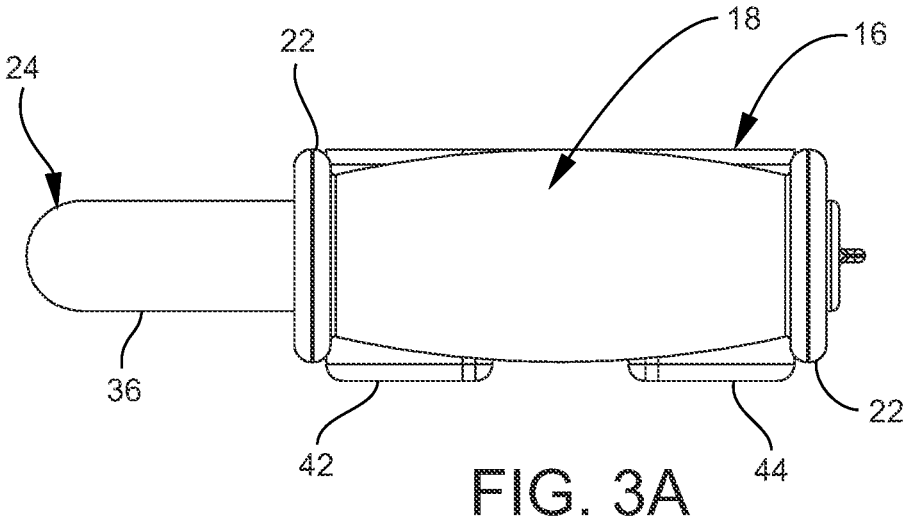
FIG. 3A is a top view of the cane apparatus of FIG. 1A, and shows the pivoting step in the up position.

FIG. 1B shows that the handle 18, cane portion 12 in its entirety, platform portion 16, and base portion 14 are co-planar. Here the platform portion 16 is in the up position. Such is also shown by FIG. 3A. FIG. 3A shows a top view of the cane apparatus 10 as shown in FIG. 1C. FIG. 3A shows the platform portion 16 in the up position.

Figure 3B:
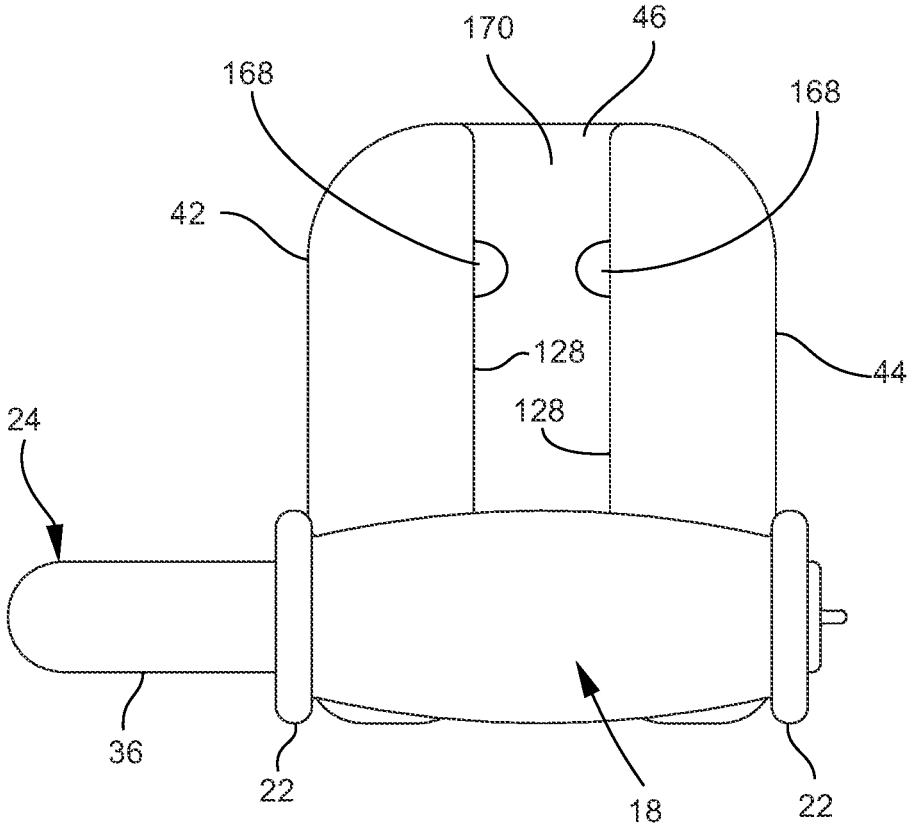
FIG. 3B is a top view of the cane apparatus of FIG. 2A, and shows the pivoting step in the down position.

In FIG. 2B, the handle 18 traverses the platform portion 16 from the first platform section 42 to the second platform section 44. Such is also shown in FIG. 3B. FIG. 3B further shows that, in the down position of the platform portion 16, the handle 18 is disposed directly vertically over one end of the platform portion 16, not directly vertically over the middle of the platform portion 16, and not directly vertically over the free or distal end of the platform portion 16.

FIG. 3A shows that, in the up position of the platform portion 16, the offset portion 24 of the cane portion 12 is offset from the platform portion 16. FIG. 3B shows that, in the down position of the platform portion 16, the offset portion 24 of the cane portion 12 is offset from the platform portion 16.

FIG. 4A shows that the pivot pins 82 are captured during assembly of the platform portion 16. The pivot pins 82 are engaged with sub-parts 74, 78 and then sub-parts 76, 80 are engaged to sub-parts 74, 78 to engage the pivot pins 82 and base portion 14 to the cane apparatus 10.

Figure 4B:
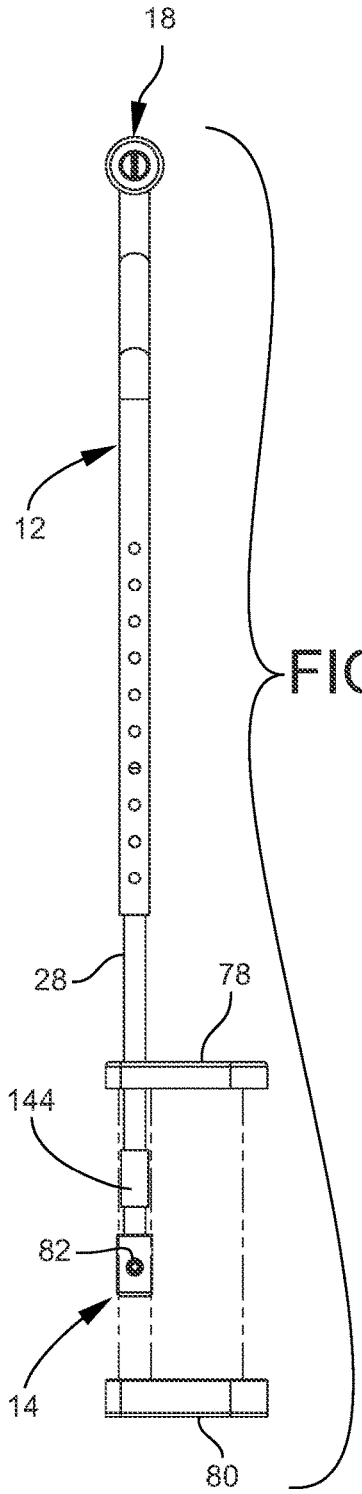
FIG. 4B is a rear exploded view of the cane apparatus of FIG. 4A.

FIGS. 4A and 4B show the resilient cylinder 144 out of the base portion 14 and telescoping part 28 in the base portion 14. However, such is for illustrative purposes only. Resilient cylinder 144 is preferably permanently engaged in base portion 14 and telescoping part 28 is engagable and disengagable from the resilient cylinder 144 that is glued or otherwise permanently engaged in the cylindrical portion 138 of the base portion 14.

The structure and function of the platform portion 16 in FIGS. 7A, 7B, 7C, 8A, 8B, and 8C is generally the same as the structure and function of the platform portion 16 in respective FIGS. 1A, 1B, 1C, 2A, 2B, and 2C.

The structure and function of the cane portion 12 in FIGS. 7A, 7B, 7C, 8A, 8B, and 8C is generally the same as the structure and function of the cane portion 12 in respective FIGS. 1A, 1B, 1C, 2A, 2B, and 2C.

Whereas the cane apparatus 151 of FIGS. 7A, 7B, 7C, 8A, 8B, and 8C has base portion 149, the cane apparatus 100 shown in FIGS. 1A, 1B, 1C, 2A, 2B, and 2C includes base portion 14. Slight differences between the platform portion 16 in FIGS. 1A, 1B, 1C, 2A, 2B, and 2C and the platform portion 16 in FIGS. 7A, 7B, 7C, 8A, 8B, and 8C can be traced to differences between base portions 14 and 149.

Figure 7A:
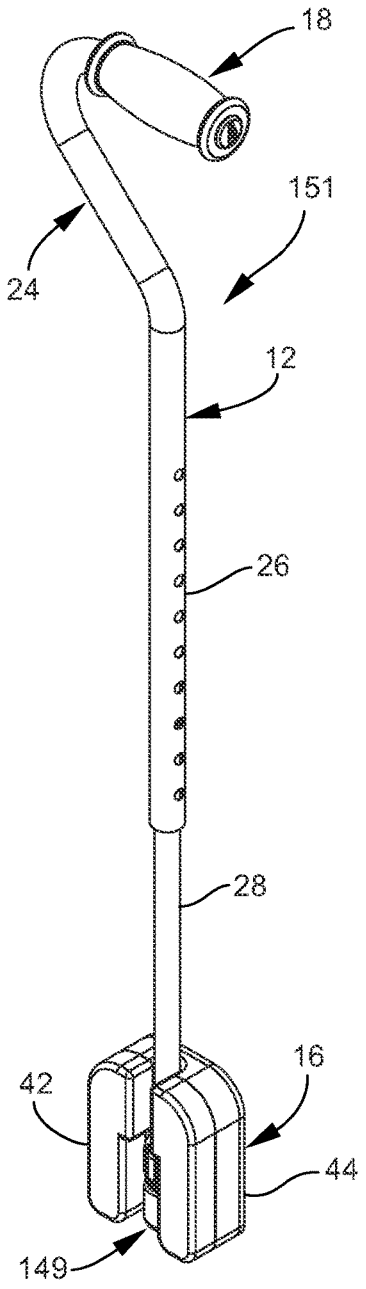
FIG. 7A is a perspective view of a second embodiment of the present cane apparatus, where the cane apparatus includes a cane and a pivoting step, and shows the pivoting step in an up position.
Figure 7B:
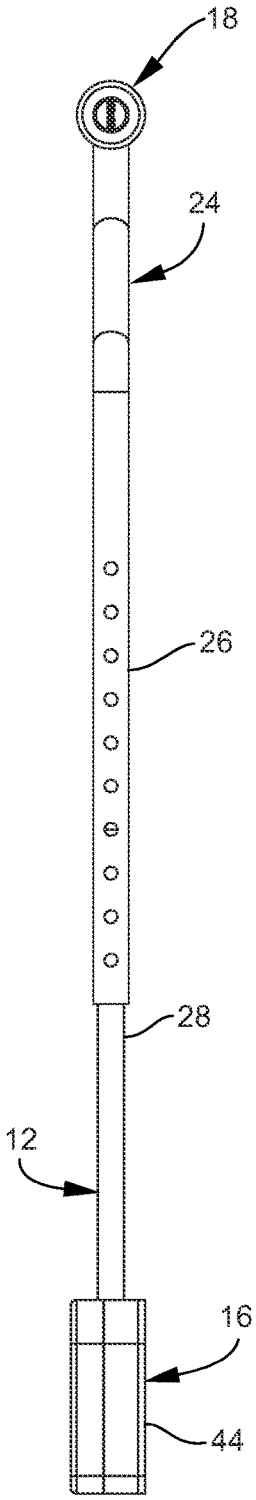
FIG. 7B is a rear view of the cane apparatus of FIG. 7A, and shows the pivoting step in the up position.
Figure 9A:
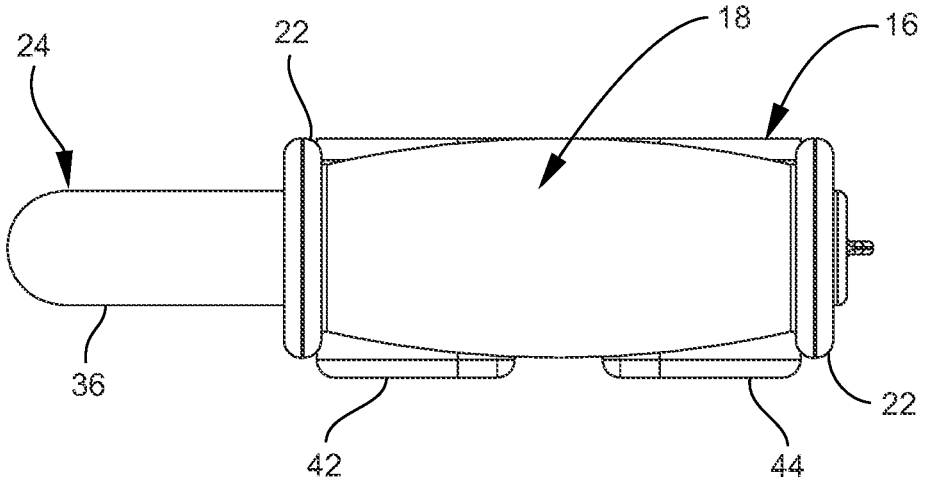
FIG. 9A is a top view of the cane apparatus of FIG. 7A, and shows the pivoting step in the up position.

FIG. 9A is a top view of the cane apparatus of FIG. 7B and is identical to the top view of the cane apparatus shown in FIG. 3A, though the underlying cane apparatus of FIG. 9A is different from the underlying cane apparatus of FIG. 3A because the cane apparatus of FIG. 9A has base portion 149 while the cane apparatus of FIG. 3A has base portion 14.

Figure 9B:
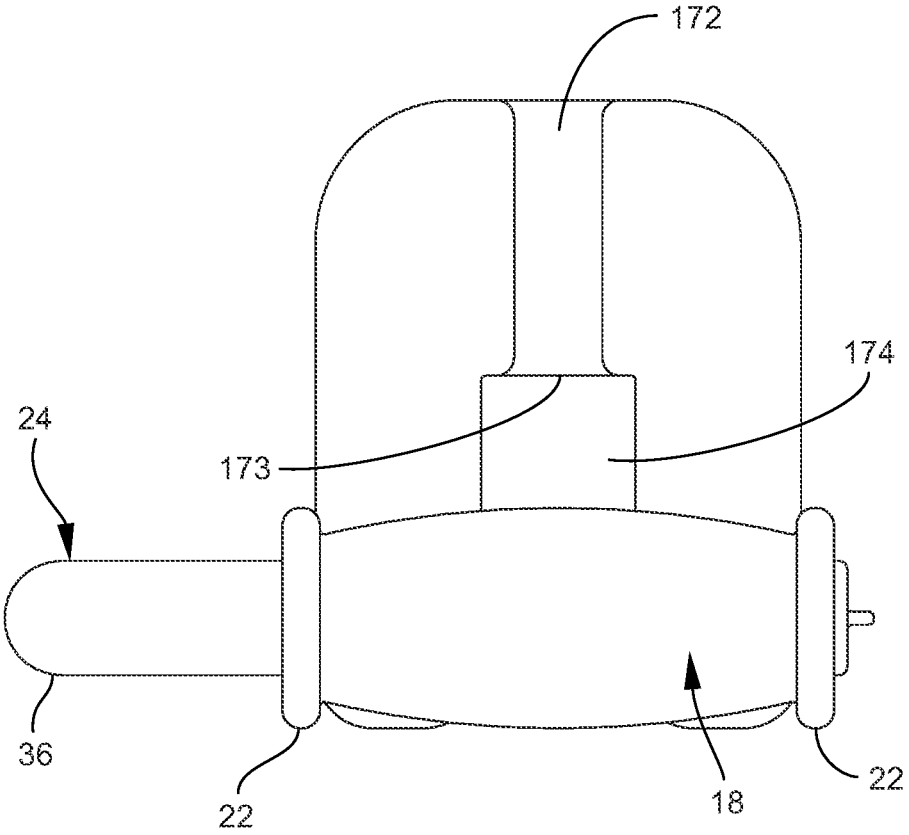
FIG. 9B is a top view of the cane apparatus of FIG. 7A, and shows the pivoting step in the down position.

In FIG. 3B, platform portion 16 has a channel portion 170 formed by an upper surface of the intermediate portion 46, the seventh surface 128 of the first platform section 42 and the seventh surface 128 of the second platform section 44. The telescoping part 28 of the cane portion 12 is engaged and disengaged from channel portion 170 when the holes 166 are engaged and disengaged with tabs 168. In FIG. 3B, the seventh surfaces 128 are straight with the exception of the tabs 168 that may be integral with the seventh surfaces 128 and the first and second platform sections 42, 44. In FIG. 9B, telescoping part 28 is received in channel portion 172 and the cap portion 152 of the base portion 149 is received in channel portion 174. Channel portions 172, 174 communicate with each other. Channel portion 174 is deeper and wider than channel portion 172 such that there is a step or step up 173 in platform portion 16 from channel portion 174 to channel portion 172.

Platform portion 16 includes a channel portion 175, shown in FIG. 2C, that extends from the plane defined by the third face portions 56, 58 to the plane defined by the second face portions 55, 57, 59. Channel portion 175 also extends inwardly from first face portions 48, 50. Channel portion 175 receives base portion 14 or base portion 149 when the platform portion 16 is in the down position as shown in FIG. 2C.

Straight channel portion 175 in combination with straight channel portion 170 forms an L-shaped channel. Straight channel portion 175 in combination with straight channel portions 172, 174 forms the L-shaped channel.

Channel portion 170 extends inwardly into the platform portion 16 from the third face portions 56, 58 and includes an axis. The cane portion 12 includes a straight section defined by telescoping parts 26, 28, and this straight section includes an axis. Channel portion 170 receives this straight section of the cane portion 12 when the platform portion 16 is in the up position such that the axis of the channel portion 170 of the platform portion 16 and the axis of such straight section of the cane portion 12 are parallel.

The fourth face portions 60, 62 are opposite of the first face portions 48, 50, and the channel portion 170 extends inwardly into the platform portion 16 from the fourth face portions 60, 62 to permit the cane portion 12 to extend out of a fourth face defined by the fourth face portion 60, 62 when the platform portion 16 is in the up position.

Channel portion 170 communicates with channel portion 175 to form, as a whole, the L-shaped channel portion, such that this channel combination extends inwardly into the platform portion 16 from a first face defined by first face portions 48, 50 to the fourth face. Channel portion 175 extends inwardly from the first face portions 48, 50 to permit the base face 52 of the base portion 14 to pivot into a plane with the first face portions 48, 50 when the platform portion 16 is pivoting into the up position.

Channel portion 175 further extends inwardly into the platform portion 16 from a plane defined by the second face 54 and its second face portions 55, 57, 59 to permit the base face 52 of the base portion 14 to pivot into a plane with the second face 54 and second face portions 55, 57, 59 when the platform portion 16 is pivoting into the down position.

Platform portion 16 includes first and second channel sections or portions that can be identified as a) channel portion 170 (in FIG. 3B) and b) channel portion 175 (in FIG. 2C) with respect to base portion 14 or a) channel portions 172, 174 (in FIG. 9B) and b) channel portion 175 (in FIG. 8C) with respect to base portion 149. Such first and second channel sections or portions form the L-shape. The cane portion 14 includes a straight section (defined by telescoping parts 26, 28) with a straight axis. In the up position of the platform portion 16, such first channel section or portion is co-axial with such straight axis of such straight section of the cane portion 12. In the down position of the platform portion 16, such first channel section or portion is perpendicular to such straight axis of such straight section of the cane portion 12. In the up position of the platform portion 16 the handle 18 extends transversely relative to each of such first and second channel sections or portions. In the down position of the platform portion 16 the handle 18 extends transversely to each of such first and second channel sections or portions of the platform portion 16.

Figure 10A:
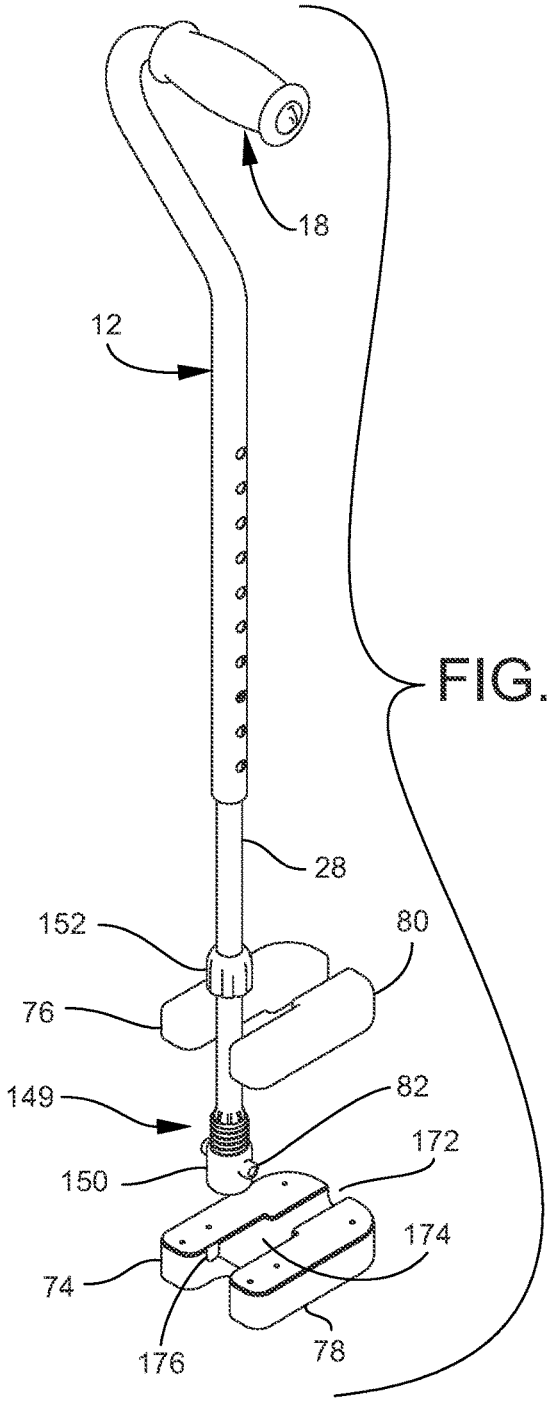
FIG. 10A is a perspective exploded view of the cane apparatus of FIG. 7A.
Figure 10B:
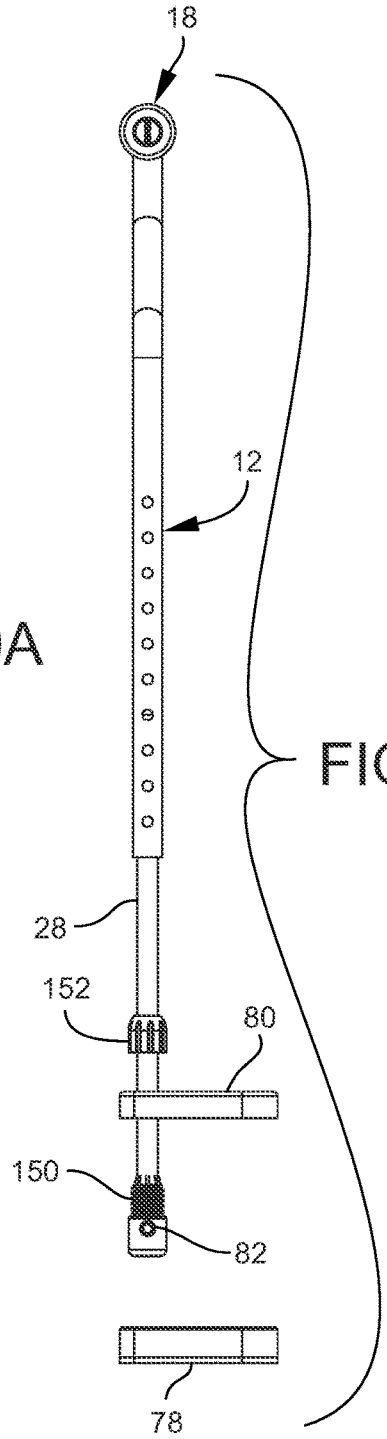
FIG. 10B is a rear exploded view of the cane apparatus of FIG. 10A.

FIGS. 10A and 10B show how base portion 149 is captured and engaged by the platform portion 16. Here platform portion 16 is slightly different than platform portion 16 shown in FIG. 4A. Here, in FIGS. 10A and 10B, platform portion 16 has channel portions 172 and 174 as shown in FIG. 9B. Base portion 149 is captured and engaged by platform portion 16 by first engaging the pivot pins 82 of base portion 149 in receptors 176 in sub-parts 74, 80. Then sub-part 76 is engaged to sub-part 74 and sub-part 80 is engaged to sub-part 78, whereupon base portion 149 is pivotable in platform portion 16.

FIG. 11 is a detail view of base portion 149. Socket portion 150 includes the cylindrical socket 158 that receives the telescoping portion 28 of the cane portion 12. Socket portion 150 further includes the body portion 154 that extends from base face 52 to the most inner portion of the cylindrical socket 158. Socket portion 150 extends from the most inner portion of the cylindrical socket 158 to the open end of the cylindrical socket 158. The exterior face of socket portion 150 includes exterior threads 178 that engage inner threads 180 of the cap portion 152 of the base portion 149.

FIG. 12 shows that tabs 168 may be located at a slightly different location than shown in FIG. 3B. A location that maximizes the distance from pivot pins 82 to tabs 168 provides greater leverage for the engagement and disengagement of the tabs 168 into and out of the openings 166, and the location in FIG. 12 provides this advantage over the location shown in FIG. 3B.

Each of FIGS. 13A, 13B, 14A, and 14B show an isolated view of base portion 149.

The platform portion 16 includes the first and second platform sections 42, 44 interconnected by the intermediate platform section 46. The first platform section 42 includes a portion of each of the first, second, and third faces 49, 54, 53. The second platform section includes a portion of each of the first, second, and third faces 49, 54, 53. The intermediate platform section 46 includes a portion of the second face 54. The intermediate platform section 46 is spaced from the third face 56. The intermediate platform section 46 is spaced from the first face 49.

The first and second platform sections 42, 44 includes the first part 76 engaged during assembly to the second part 74. The first part 76 includes a portion of the first face 49 and a portion of the third face 53. The second part 74 includes a portion of the first face 49 and a portion of the second face 54.

The fourth face 61 is opposite to the first face 49. The first platform section 42 includes the first platform interior integral support 84 extending between the first and fourth faces 49, 61 of the first platform section 42 and being spaced from the second and third faces 54, 53 of the first platform section 42. The second platform section 44 includes the second platform interior integral support 86 extending between the first and fourth faces 49, 61 of the second platform section 44 and being spaced from the second and third faces 54, 53 of the second platform section 44.

The intermediate platform section 46 is adjacent to the base portion 14 or base portion 149 when the platform portion 16 is in the up position. The intermediate platform section 46 is spaced from the base portion 14 or base portion 149 when the platform portion 16 is in the down position.

The fourth face 61 is opposite of the first face 49. The first platform section 42 includes the first portion 60 of the fourth face 61 that tapers downwardly and away from the cane portion 12 when the platform portion 16 is in the up position. The second platform section 44 includes the second portion 62 of the fourth face 61 that tapers downwardly and away from the cane portion 12 when the platform portion 16 is in the up position.

In the up position of the platform portion 16, the platform portion 16 extends to a first distance from a first side of the cane portion 12 and to a second distance from a second side of the cane portion 12. Such first and second distances are substantially equal to each other.

Figure 7C:
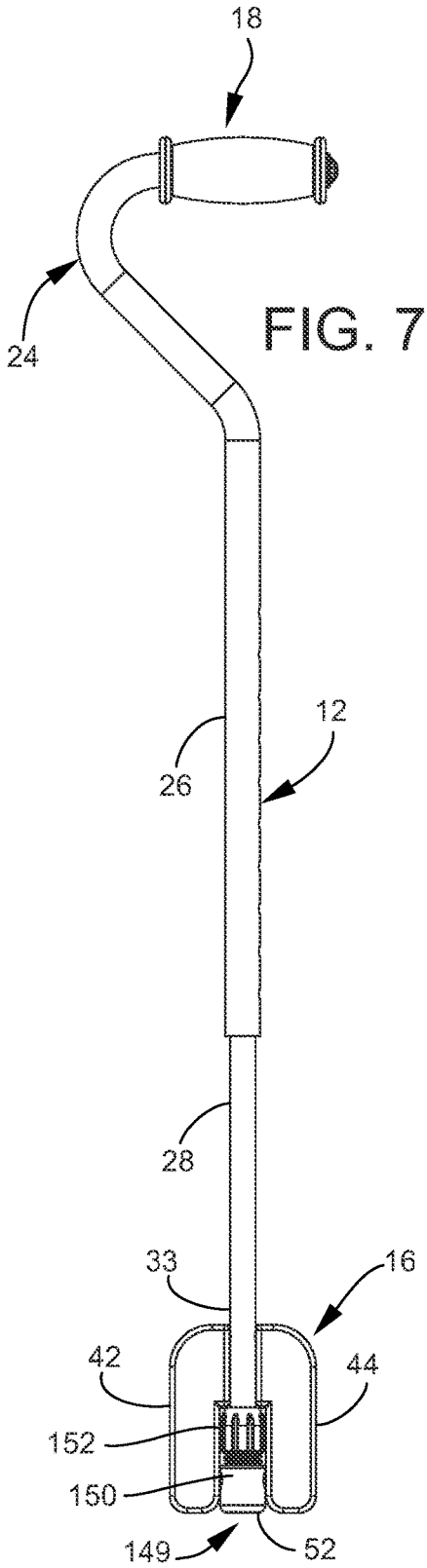
FIG. 7C is a side view of the cane apparatus of FIG. 7A, and shows the pivoting step in the up position.
Figure 8A:
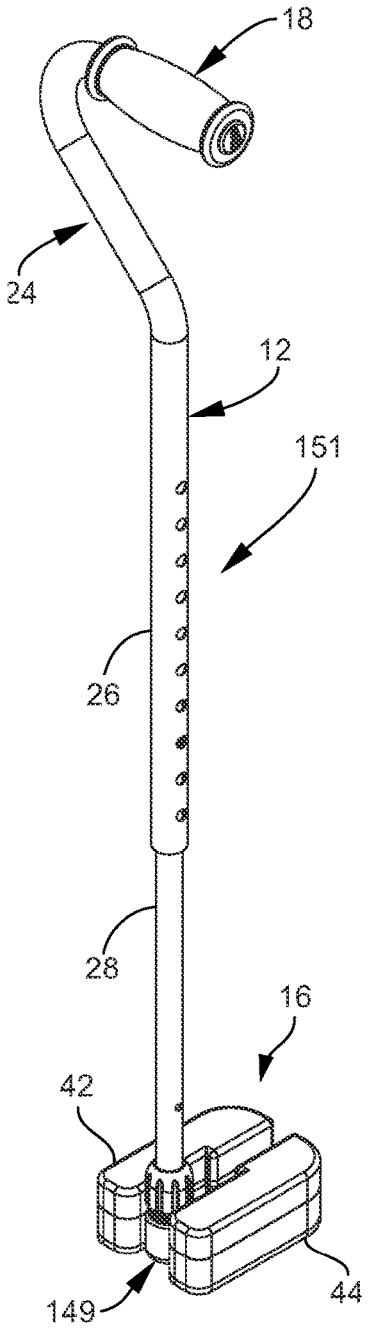
FIG. 8A is a perspective view of the cane apparatus of FIG. 7A, and shows the pivoting step in a down position.
Figure 8B:
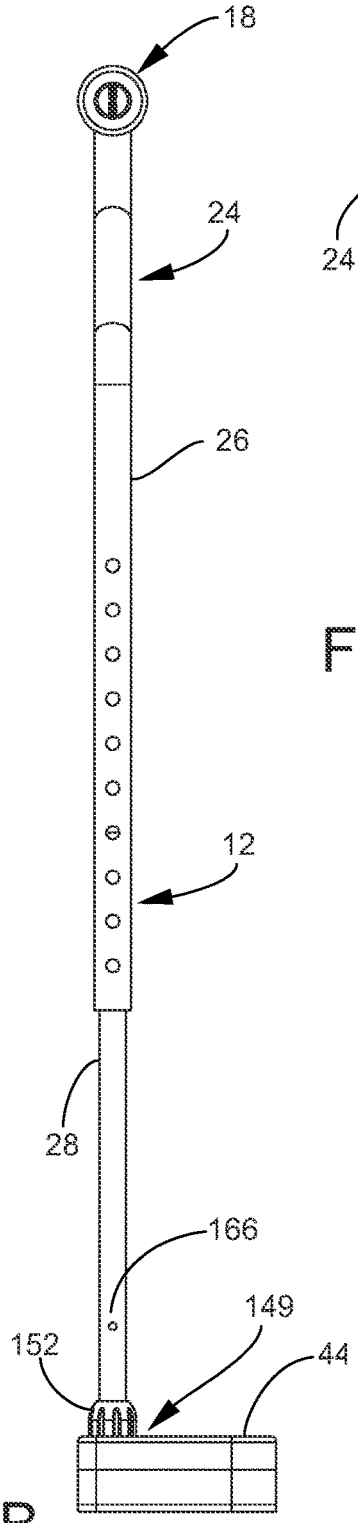
FIG. 8B is a rear view of the cane apparatus of FIG. 8A, and shows the pivoting step in the down position.
Figure 8C:
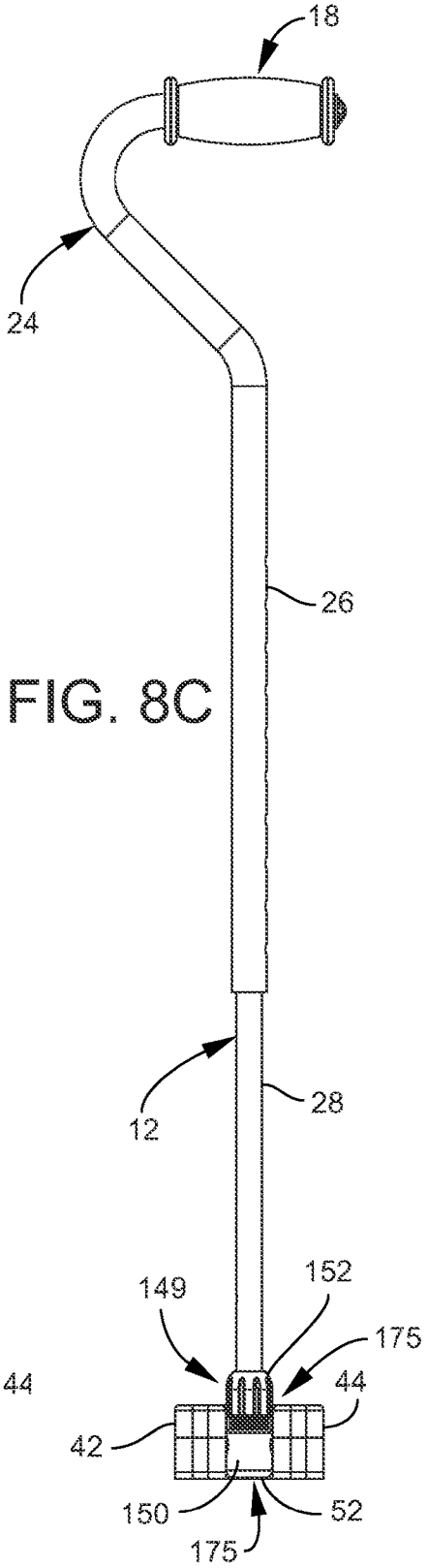
FIG. 8C is a side view of the cane apparatus of FIG. 8A, and shows the pivoting step in the down position.

In operation, when the cane apparatus is used for walking, the platform portion 16 is in the up position as shown in FIGS. 1A, 1B, and 1C (with base portion 14) or as shown in FIGS. 7A, 7B, and 7C (with base portion 149). Here the first face 49 and its first face portions 48, 50 make contact with the ground along with base face 52 of base portion 14 or base face 52 of base portion 149. Most of the load is borne by base face 52 and the cane portion 12 when walking. However, a portion of the load is transmitted through the pivot pins 82 such that a portion of the load is borne by first face 49 and its first face portions 48, 50.

When the user approaches a change in the elevation, such as a step that the user would like to go up on, the platform portion 16 is pivoted to the down position by the foot or hand of the user. Then the second face 54 and its face portions 55, 57, 59 make contact with the ground surface below the run of the step. Then the user steps with a first foot off the ground surface and onto the third face 53 and its face portions 56, 58. Then the user steps with the second foot onto the run of the step. Then the user steps with the first step off the platform portion 16 and onto the run of the step. Then, if this is the only step, the user pivots the platform portion 16 to the up position and walks away. During this process, the user's hand is gripping the handle 18. During this process, when the user's foot is off the platform portion 16, the load is borne mostly by the base face 52, though a portion of the load may be transmitted through the pivot pins 22 to the second face 54 and its face portions 55, 57, 59. When the user steps on the platform portion 16, most of the load is borne by the second face 54 and its face portions 55, 57, 59, though a portion of the load may be transmitted through the pivot pins 22 to the base face 52 of base portion 14 (or base portion 149).

When cane portion 12 is desired to be disengaged from the cane apparatus having the base portion 12 with the resilient cylinder 144, the cane portion 12 is twisted to and from, or rotated in one direction, or rotated in the other direction, or rotated back and forth, to disengage the cane portion 12 from the resilient cylinder 144. Then the cane portion 12 is isolated and may be used as a conventional cane. To engage the cane portion 12 back into the base portion 12, the cane portion 12 is twisted to and from, or rotated in one direction, or rotated in the other direction, or rotated back and forth, to engage the cane portion 12 with the resilient cylinder 144 until the cane portion 12 is set therein. Such an engagement or disengagement of the cane portion 12 can take place when the platform portion 16 is in either the up or down position.

When cane portion 12 is desired to be disengaged from the cane apparatus having the base portion 149, the platform portion is first placed in the down position. Then the cap portion 152 is screwed off the socket portion 150. Then the cane portion 12 may be removed from the socket portion 150 and withdrawn from the platform portion 16. Then the cap portion 152 may be slid off the distal end of the cane portion 12 and screwed back on the socket portion 150 so as not to displace or lose the cap portion 152. Then the cane portion 12 may be used as a conventional cane. Engagement of the cane portion 12 with the base portion 140 is the opposite of such disengagement. The engagement and disengagement steps are performed when the platform portion is in the down position. If disengagement is attempted when the platform portion 16 is in the up position, then the step up 173 blocks the axial outward rotation of the cap portion 152.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A cane apparatus, comprising:

a) a cane portion, the cane portion having a proximal end section with a handle, the cane portion further having a distal end section;

b) a base portion, the base portion receiving and engaging the distal end section of the cane, the base portion having a base face;

c) a platform portion, the platform portion being pivotally engaged to the base portion, the platform portion having first, second, and third faces, the platform portion being pivotable to an up position where the first face of the platform portion and base face of the base portion define a plane, the platform portion being pivotable to a down position where the second face of the platform portion and base face of the base portion define a plane, the third face of the platform portion being opposite of the second face of the platform portion and being stepped upon by the user when the platform portion is in the down position, the first face of the platform portion being disposed transversely to each of the second and third faces of the platform portion;

d) the base face of the base portion and the first face of the platform portion making contact with a ground surface when the platform portion is in the up position and when the cane apparatus is used for walking; and e) the base face of the base portion and the second face of the platform portion making contact with the ground surface when the platform portion is in the down position and when the platform portion is used to assist the user when the user is climbing or descending a change in height of the ground surface.

2. The cane apparatus of claim 1, wherein the platform portion includes a channel extending inwardly into the platform portion from the third face and having an axis, wherein the cane portion includes a straight section having an axis, and wherein the channel receives the straight section of the cane portion when the platform portion is in the up position such that the axis of the channel of the platform portion and axis of the straight section of the cane portion are parallel.

3. The cane apparatus of claim 2, wherein the platform portion includes a fourth face, the fourth face being opposite of the first face, and the channel further extending inwardly into the platform portion from the fourth face to permit the cane portion to extend out of the fourth face of the platform portion when the platform portion is in the up position.

4. The cane apparatus of claim 2, wherein the channel further extends inwardly into the platform portion from the first face to permit the base face of the base portion to pivot into a plane with the first face when the platform portion is pivoting into the up position.

5. The cane apparatus of claim 2, wherein the channel further extends inwardly into the platform portion from the second face to permit the base face of the base to pivot into a plane with the second face when the platform portion is pivoting into the down position.

6. The cane apparatus of claim 1, wherein the cane portion includes an offset section and a straight section, the straight section of the cane portion having a straight axis, the offset portion of the cane portion extending away from the straight section of the cane portion and away from the handle, the straight axis intersecting the handle, the distal end section of the cane portion, and the base face of the base portion, the straight section extending into the offset section, the offset section extending into the handle, the offset section being offset from the straight axis of the straight section.

7. The cane apparatus of claim 1, wherein the platform portion includes first and second channel sections, wherein the cane portion includes a straight section with a straight axis, wherein in the up position of the platform portion the first channel section is co-axial with the straight axis of the straight section of the cane portion, wherein in the down position of the platform portion the first channel section is perpendicular to the straight axis of the straight section of the cane portion, wherein in the up position of the platform portion the handle extends transversely relative to each of the first and second channel sections, and wherein in the down position of the platform portion the handle extends transversely to each of the first and second channel sections of the platform portion.

8. The cane apparatus of claim 1, wherein the distal end section of the cane portion is engagable and disengagable from the base portion such that the cane portion may be removed from the base portion and be used as a support for walking without the base portion.

9. The cane apparatus of claim 8, wherein base portion includes a resilient sidewall that resiliently engages the distal end section of the cane portion when the distal end section of the cane portion is pushed into the base portion.

10. The cane apparatus of claim 8, wherein the base portion includes a cap portion and a socket portion that are threadably engagable to and threadably disengagable from each other, the socket portion receiving the distal end section of the cane portion, and the cap portion when threadably engaging the socket portion decreasing a diameter of the socket portion such that the socket portion tightens about the distal end section of the cane portion to engage the distal end section of the cane portion with the base portion.

11. The cane apparatus of claim 1, wherein the cane portion includes an opening and the platform portion includes a tab, the tab of the platform portion engaging the opening of the cane portion when the platform portion is in the up position to removably hold the platform portion in the up position.

12. The cane apparatus of claim 11, wherein the tab of the platform portion and opening of the cane portion is a friction fit engagement.

13. The cane apparatus of claim 11, wherein platform portion includes a channel in which the cane portion is received when the platform portion is in the up position, the platform portion including a surface that forms at least a portion of the channel, and wherein the tab extends from the surface.

14. The cane apparatus of claim 1, wherein the cane portion includes a straight section between the handle and the distal end section, the straight section being extendible in length between at least first and second positions, the cane portion being lockable at the first and second positions.

15. The cane apparatus of claim 1, wherein the cane portion includes a straight section between the handle and the distal end section, the straight section having a first telescoping part and a second telescoping part, the first and second telescoping parts being lockable at a first position and at a second position such that the cane portion is extendible and retractable in length.

16. The cane apparatus of claim 1, wherein the platform portion includes first and second platform sections interconnected by an intermediate platform section, the first platform section having a portion of each of the first, second, and third faces, the second platform section having a portion of each of the first, second, and third faces, the intermediate platform section having a portion of the second face, the intermediate platform section being spaced from the third face, and the intermediate platform section being spaced from the first face.

17. The cane apparatus of claim 1, wherein the platform portion includes first and second platform sections interconnected by an intermediate platform section, each of the first and second platform sections having a first part engaged during assembly to a second part, the first part having a portion of the first face and a portion of the third face, the second part having a portion of the first face and a portion of the second face.

18. The cane apparatus of claim 17, and further including a first pivot connection between the first platform section and the base portion and a second pivot connection between the second platform section and the base portion, the first and second parts of the first platform section engaging the first pivot connection, the first and second parts of the second platform section engaging the second pivot connection.

19. The cane apparatus of claim 17, further including a fourth face opposite to the first face, wherein the first platform section includes a first platform interior integral support extending between the first and fourth faces of said first platform section and being spaced from the second and third faces of said first platform section, and wherein the second platform section includes a second platform interior integral support extending between the first and fourth faces of said second platform section and being spaced from the second and third faces of said second platform section.

20. The cane apparatus of claim 1, wherein the platform portion includes first and second platform sections interconnected by an intermediate platform section, the intermediate platform section being adjacent to the base portion when the platform portion is in the up position, the intermediate platform section being spaced from the base portion when the platform portion is in the down position.

21. The cane apparatus of claim 1, wherein the platform portion further includes a fourth face, the fourth face being opposite of the first face, and wherein the platform portion includes first and second platform sections interconnected by an intermediate platform section, the first platform section including a first portion of the fourth face that tapers downwardly and away from the cane portion when the platform portion is in the up position, and the second platform section including a second portion of the fourth face that tapers downwardly and away from the cane portion when the platform portion is in the up position.

22. The cane apparatus of claim 1, wherein the platform portion includes first and second platform sections, each of the first and second platform sections including an interior network structure.

23. The cane apparatus of claim 1, wherein in the up position of the platform portion, the platform portion extends to a first distance from a first side of the cane portion and to a second distance from a second side of the cane portion, with the first and second distances being substantially equal to each other.

* * * * *